US010160220B2

(12) United States Patent
Moriyama et al.

(10) Patent No.: US 10,160,220 B2
(45) Date of Patent: Dec. 25, 2018

(54) LIQUID STORAGE UNIT AND LIQUID EJECTION APPARATUS

(71) Applicant: Seiko Epson Corporation, Tokyo (JP)

(72) Inventors: Ryuji Moriyama, Matsumoto (JP); Hisayuki Akahane, Matsumoto (JP); Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/827,281

(22) Filed: Nov. 30, 2017

(65) Prior Publication Data

US 2018/0154641 A1 Jun. 7, 2018

(30) Foreign Application Priority Data

Dec. 2, 2016 (JP) ..... 2016-235005

(51) Int. Cl.
*B41J 2/175* (2006.01)
*B41J 29/13* (2006.01)
*B41J 29/02* (2006.01)

(52) U.S. Cl.
CPC ..... *B41J 2/17523* (2013.01); *B41J 2/17509* (2013.01); *B41J 2/17553* (2013.01); *B41J 29/13* (2013.01); *B41J 2/1754* (2013.01); *B41J 29/02* (2013.01)

(58) Field of Classification Search
CPC .. B41J 2/1752; B41J 2/17509; B41J 2/17523; B41J 2/17553; B41J 29/13
USPC ..... 347/84–86
See application file for complete search history.

(56) References Cited

U.S. PATENT DOCUMENTS

| | | | | |
|---|---|---|---|---|
| 8,454,139 | B2 * | 6/2013 | Ishizawa | B41J 2/175 347/84 |
| 9,597,883 | B2 * | 3/2017 | Kudo | B41J 2/1752 |
| 9,834,001 | B2 * | 12/2017 | Tanaka | B41J 2/175 |
| 2010/0329704 | A1 | 12/2010 | Tachibana | |
| 2015/0258800 | A1 | 9/2015 | Tanaka et al. | |
| 2016/0263901 | A1 | 9/2016 | Kudo et al. | |

FOREIGN PATENT DOCUMENTS

| | | | |
|---|---|---|---|
| JP | H10-171552 | A | 6/1998 |
| JP | H11-073242 | A | 3/1999 |
| JP | 2001-290556 | A | 10/2001 |
| JP | 2005-313453 | A | 11/2005 |
| JP | 2011-008142 | A | 1/2011 |
| JP | 2016-155269 | A | 9/2016 |

(Continued)

*Primary Examiner* — An Do
(74) *Attorney, Agent, or Firm* — Foley & Lardner LLP

(57) ABSTRACT

A liquid storage unit includes at least one liquid storage part that stores liquid to be supplied to a liquid ejection part ejecting the liquid and includes an injection port to which the liquid is injectable, a first opening/closing body that is openable so as to cover the injection port when the first opening/closing body is closed, and a locking part that locks the first opening/closing body and keeps the closed state of the first opening/closing body. The first opening/closing body includes a first insertion hole through which a locking member locking the closed first opening/closing body is insertable. The locking part is provided at a position facing the first insertion hole in an area covered by the closed first opening/closing body, and includes a second insertion hole through which the locking member is insertable.

18 Claims, 21 Drawing Sheets

(56) References Cited

FOREIGN PATENT DOCUMENTS

| | | | |
|---|---|---|---|
| JP | 2016-159063 | A | 9/2016 |
| JP | 2016-168727 | A | 9/2016 |
| WO | WO-2005/011987 | A1 | 2/2005 |

* cited by examiner

LIQUID STORAGE UNIT AND LIQUID EJECTION APPARATUS

CROSS-REFERENCE TO RELATED APPLICATIONS

This application claims priority to Japanese Patent Application No. 2016-235005, filed Dec. 2, 2016, the disclosure of which is incorporated by reference herein in its entirety.

BACKGROUND

Field

The present invention relates to a liquid storage unit storing liquid to be supplied to a liquid ejection part, and a liquid ejection apparatus including the liquid storage unit.

Related Art

An ink jet printer as an example of a liquid ejection apparatus may include a recording head that ejects ink as liquid onto a recording medium for recording, and a liquid storing part that stores ink to be supplied to the recording head and allows refilling of ink to be consumed, in which the liquid storage part is arranged and housed in a liquid storage unit provided in an apparatus main body (e.g., JP2016-168727A).

In JP2016-168727A, the liquid container unit 30 includes the case body 44 in which the liquid container 50 as the liquid storing part is arranged, and the cover 42 opening and closing the upper part of the case body 44. In order to reduce a possibility that the cover 42 is opened unnecessarily, the liquid container unit 30 includes the locking mechanism 20 keeping the cover 42 closed by locking. The locking mechanism 20 is configured including the first through hole 221 and the second through hole 241, to which the padlock 21 is attached.

In the locking mechanism 20 described in JP2016-168727A, the first insertion portion 22 and the second insertion portion 24 on which the first through hole 221 and the second through hole 241 are provided project on the outside of the liquid container unit 30. This deteriorates designability and compactness of appearance. Moreover, an object may be easily brought into contact externally with the first insertion portion 22 and the second insertion portion 24 projecting on the outside of the liquid container unit 30, which may cause damages and reduce robustness of the liquid container unit 30 itself.

Therefore, the invention aims at providing a liquid storage unit that is lockable with the cover closed, and is high in designability and compactness of appearance, and high in robustness, and a liquid ejection apparatus including the liquid storage unit.

SUMMARY

To solve the above-described problem, a liquid storage unit according to a first aspect of the invention includes at least one liquid storage part that stores liquid to be supplied to a liquid ejection part ejecting the liquid and includes an injection port to which the liquid is injectable, a first opening/closing body that is openable so as to cover the injection port when the first opening/closing body is closed, and a locking part that locks the first opening/closing body and keeps the closed state thereof, in which the first opening/closing body includes a first insertion hole through which a locking member locking the closed first opening/closing body is insertable, and the locking part is provided at a position facing the first insertion hole in an area covered by the closed opening/closing body, and includes a second insertion hole through which the locking member is insertable.

According to this aspect, the locking part locking the first opening/closing body and keeping the closed state thereof is provided at a position facing the first insertion hole in the area covered by the closed first opening/closing body, and includes the second insertion hole through which the locking member is insertable, which enables an appearance in which the first insertion hole and the second insertion hole do not project from the liquid storage unit in the closed first opening/closing body. Therefore, it is possible to achieve the liquid storage unit having a compact appearance with high designability.

Moreover, it is possible to reduce a possibility that an object is externally brought into contact with a part where the first insertion hole and the second insertion hole are provided. That is, it is possible to reduce a possibility that the liquid storage unit is damaged due to external contact and improve robustness of the liquid storage unit.

The liquid storage unit according to the second aspect of the invention is characterized in that, in the first aspect, the first insertion hole is larger than the second insertion hole.

According to this aspect, the first insertion hole is larger than the second insertion hole, which makes it difficult that the locking member is brought into contact with the first insertion hole. This reduces a load applied on the first insertion hole when force is added externally onto the locked locking member, for example.

The liquid storage unit according to the third aspect of the invention is characterized in that, in the second aspect, the locking part is higher in rigidity than the first opening/closing body.

According to this aspect, the locking part with the second insertion hole is formed by a material higher in rigidity than a material forming the first opening/closing body with the first insertion hole, which improves robustness of the second insertion hole. The second insertion hole smaller than the first insertion hole is easily brought into contact with the locked locking member. However, the locking part is formed by a material high in rigidity, and thus it is possible to obtain durability even when external force is added on the locked locking member to apply a load on the second insertion hole.

The liquid storage unit according to the fourth aspect of the invention further includes, in any one of the first aspect to the third aspect, a housing that internally houses the liquid storage unit and is opened and closed by the first opening/closing body, characterized in that the first opening/closing body is closed relative to the housing with an end of a peripheral wall of the first opening/closing body butted against an end of a peripheral wall of the housing, and at least a part including the second insertion hole of the locking part projects from the housing in a height direction.

According to this aspect, the liquid storage unit in which the first opening/closing body is closed relative to the housing with the end of the peripheral wall of the first opening/closing body butted against the end of the peripheral wall of the housing, exerts the same action effects as any one of the first aspect to the third aspect.

The liquid storage unit according to the fifth aspect of the invention further includes, in any one of the first aspect to the fourth aspect, a second opening/closing body that includes a cap portion opening and closing the injection port, and is covered by the closed first opening/closing body with the injection port closed by the cap portion, characterized in that the second insertion hole is positioned between the first insertion hole and the second opening/closing body in a width direction of the liquid storage unit.

According to this aspect, in the liquid storage unit including the second opening/closing body that opens and closes the injection port and is covered by the closed first opening/closing body when the injection port is closed, the second insertion hole is arranged with space saved.

The liquid storage unit according to the sixth aspect of the invention is characterized in that, in the fifth aspect, the first insertion hole and the second insertion hole are provided at positions overlapping with at least a part of the second opening/closing body or positions lower than the second opening/closing body in the height direction.

According to this aspect, the first insertion hole and the second insertion hole are arranged at positions close to the liquid storage unit in the height direction. Thus, it is possible to reduce a load applied on the first opening/closing body where the first insertion hole is provided or the locking part where the second insertion hole is provided.

The liquid storage unit according to the seventh aspect of the invention is characterized in that, in the fifth aspect or the sixth aspect, the locking part is provided, in a depth direction, between the injection port and one end side of the second opening/closing body that is separate from the injection port in a longitudinal direction.

According to this aspect, it is possible to arrange the locking part with space saved.

The liquid storage unit according to the eighth aspect of the invention is characterized in that, in any one of the first aspect to the seventh aspect, the locking part includes a tongue-piece part with the second insertion hole and a fixing part that is extended in a direction crossing the tongue-piece part and fixed to a side of the liquid storage unit.

According to this aspect, it is possible to arrange the locking part with space saved and fix the locking part securely.

The liquid storage unit according to the ninth aspect of the invention is characterized in that, in any of the fifth aspect to the seventh aspect, the locking part includes a tongue-piece part with the second insertion hole and a fixing part that is extended in a direction crossing the tongue-piece part and fixed to a side of the liquid storage unit, and the fixing part and a fixing member fixing the fixing part are positioned on an upper side of the liquid storage unit, and at least a part of the fixing part and the fixing member is positioned on a lower side of the closed second opening/closing body.

According to this aspect, it is possible to arrange and fix the locking part with space saved.

The liquid storage unit according to the tenth aspect of the invention is characterized in that, in the ninth aspect, at least a part of the fixing part is placed at a same position in the height direction as at least a part of the injection port or at least a part of the cap portion of the second opening/closing body.

According to this aspect, it is possible to arrange and fix the locking part with space saved.

The liquid storage unit according to the 11th aspect of the invention is characterized in that, in any one of the first aspect to the tenth aspect, the first insertion hole is provided on a side surface portion on one side in the width direction of the liquid storage unit in the first opening/closing body.

According to this aspect, the first insertion hole is provided at the side surface portion of the first opening/closing body. Thus, when the liquid storage unit is viewed from the front surface side, the first insertion hole is difficult to view, allowing a simple appearance.

The liquid storage unit according to the 12th aspect of the invention is characterized in that, in any of the first aspect to the 11th aspect, the first opening/closing body includes a handhold for opening the first opening/closing body, close to a position of the first insertion hole.

According to this aspect, the handhold makes it possible to easily open and close the first opening/closing body. In addition, the first insertion hole and the handhold are provided at positions close to each other, which improves designability.

The liquid storage unit according to the 13th aspect of the invention is characterized in that, in any one of the first aspect to the 12th aspect, at least one of the first opening/closing body and the locking part includes a guide part guiding the locking part to an inner side of the first opening/closing body when the first opening/closing body is closed.

According to this aspect, the guide part is able to easily guide the locking part to the inner side of the first opening/closing body, which makes it possible to close the first opening/closing body smoothly.

The liquid storage unit according to the 14th aspect of the invention is characterized in that, in any of the first aspect to the 13th aspect, the locking part is configured to be replaceable.

According to this aspect, when force is added externally on the locked locking member and thus a failure such as a damage has occurred in the insertion hole on the opening/closing body side where a load is applied easily, the locking part may be replaced.

Moreover, when the locking mechanism is not necessary in the liquid storage unit, the locking part may be removed.

The liquid storage unit according to the 15th aspect of the invention is characterized in that, in any one of the first aspect to the 14th aspect, the first opening/closing body has a damper mechanism reducing a moving speed of the first opening/closing body at least when the first opening/closing body is closed.

According to this aspect, it is possible to move the first opening/closing body slowly at least when it is closed, which improves operability.

The liquid storage unit according to the 16th aspect of the invention is characterized in that, in the aspect of the 15th aspect, the damper mechanism includes a guided part that is provided in the first opening/closing body, a guide groove that is provided on the housing and guides the guided part when the first opening/closing body is opened and closed, and a projection provided on the guide groove, and the first opening/closing body is configured so that the guided part is brought into contact with the projection when the first opening/closing body is closed and the guided part is separable from the projection when the first opening/closing body is opened.

According to this aspect, the guided part of the first opening/closing body is brought into contact with the projection when the first opening/closing body is closed. Thus, it is possible to move the first opening/closing body slowly when it is closed by friction force due to contact between the guided part and the projection. Moreover, the first opening/closing body is configured so that the guided part is separable from the projection when the first opening/closing body is opened. Thus, it is possible to easily open the first opening/closing body with small resistance.

A liquid ejection apparatus according to the 17th aspect of the invention includes an apparatus main body with the liquid ejection part, and the liquid storage unit according to any one of the first aspect to the 16th aspect.

According to this aspect, the liquid storage unit provided in the liquid ejection apparatus exerts the same action effects as any one of the first aspect to the 16th aspect.

The liquid ejection apparatus according to the 18th aspect of the invention is characterized in that, in the 17th aspect, the first insertion hole and the second insertion hole in the liquid storage unit are arranged close to a gravity center position as a whole of the liquid ejection apparatus.

According to this aspect, when outer force is added on the locked locking member inserted in the first insertion hole and the second insertion hole, it is possible to reduce a load applied on the liquid storage unit.

DETAILED DESCRIPTION

Embodiment 1

The following will describe an overview of an ink jet printer 1 (hereinafter, simply referred to as a printer 1) as an example of a "liquid ejection apparatus" according to the invention.

Figure 1:
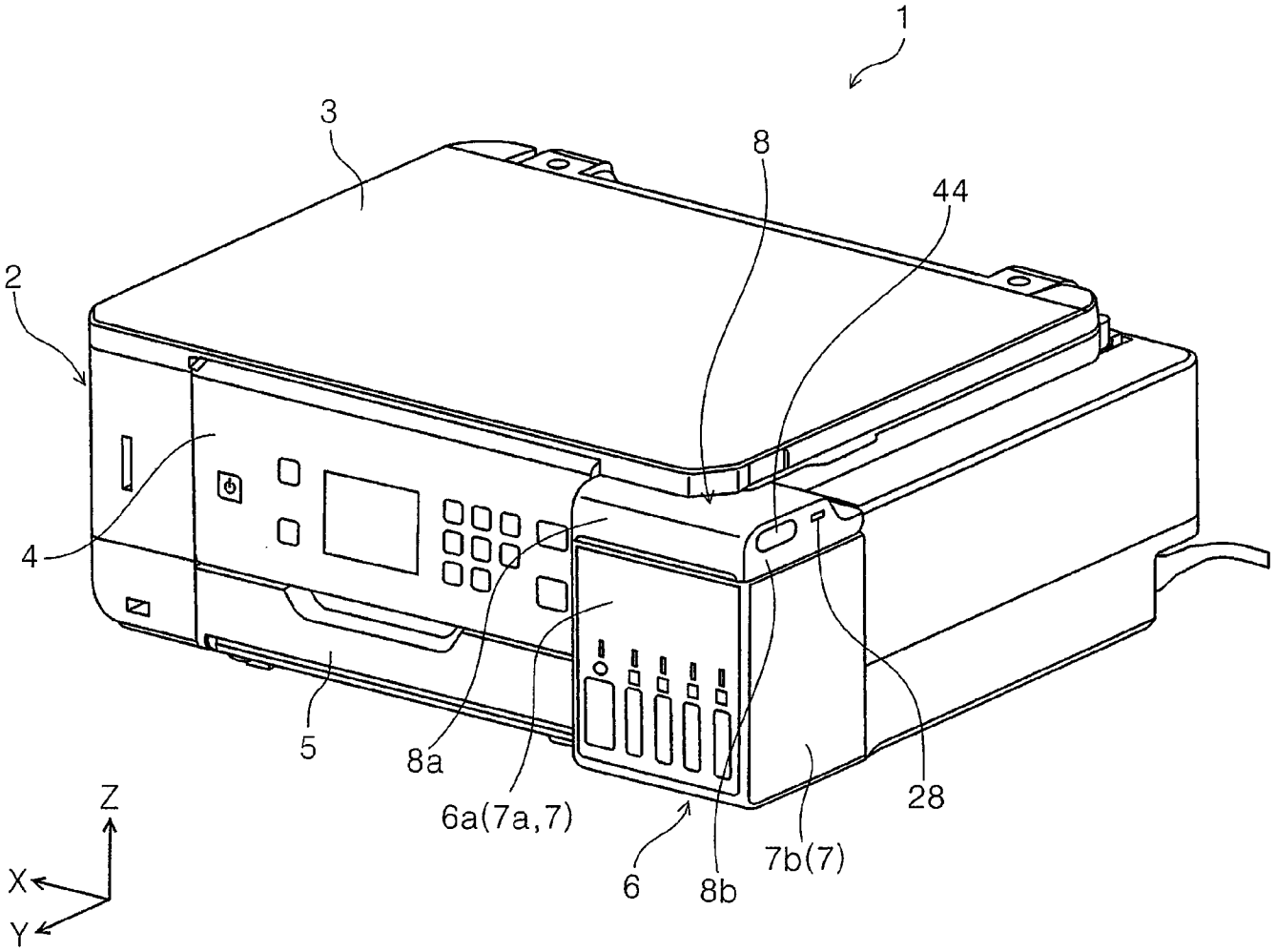
FIG. 1 is an external perspective view of a printer according to the invention.
Figure 2:
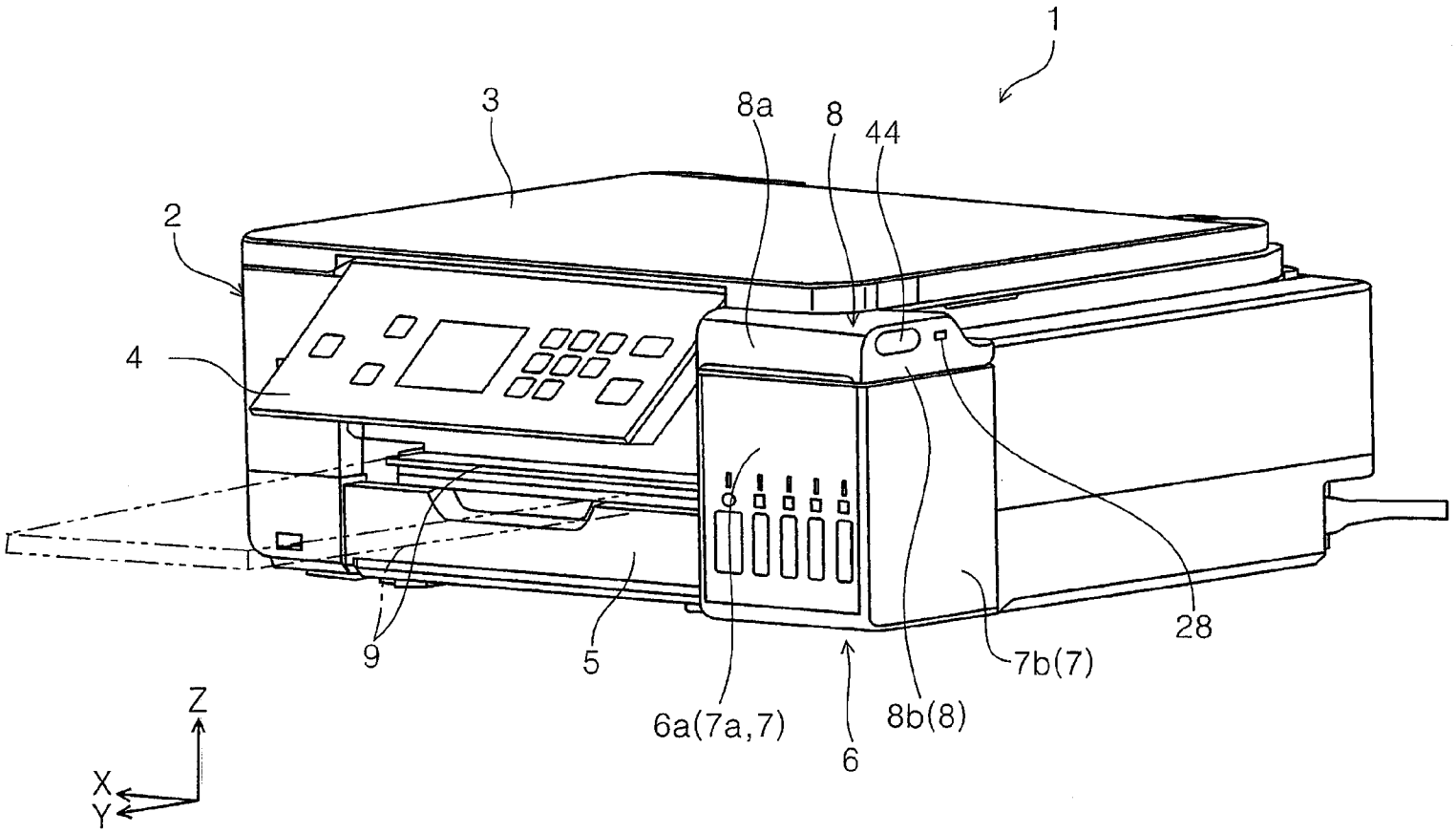
FIG. 2 is an external perspective view of the printer when an operation panel is rotated to a front surface side of the apparatus.
Figure 3:
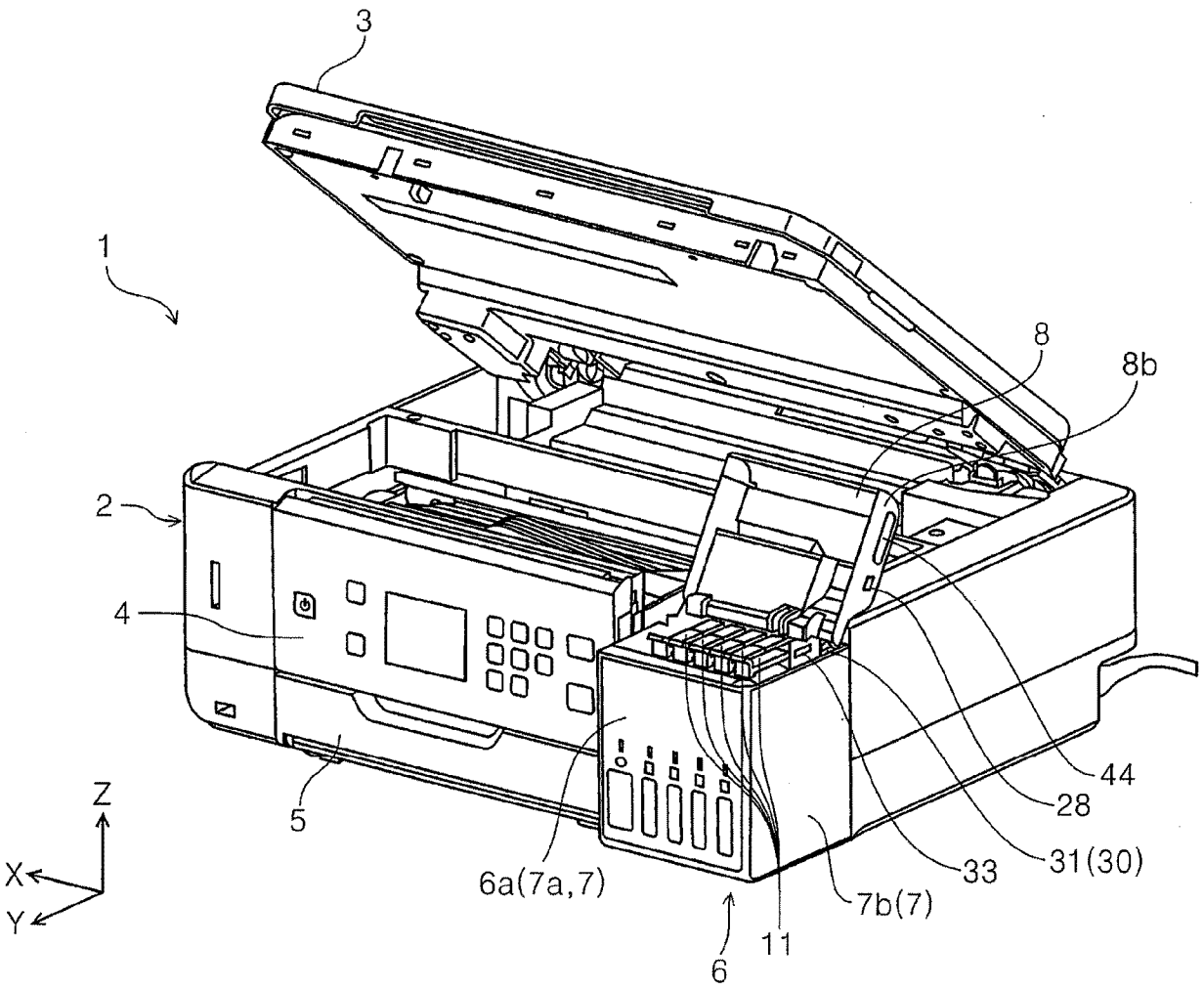
FIG. 3 is an external perspective view of the printer when a scanner and a unit cover are opened relative to the apparatus main body.
Figure 4:
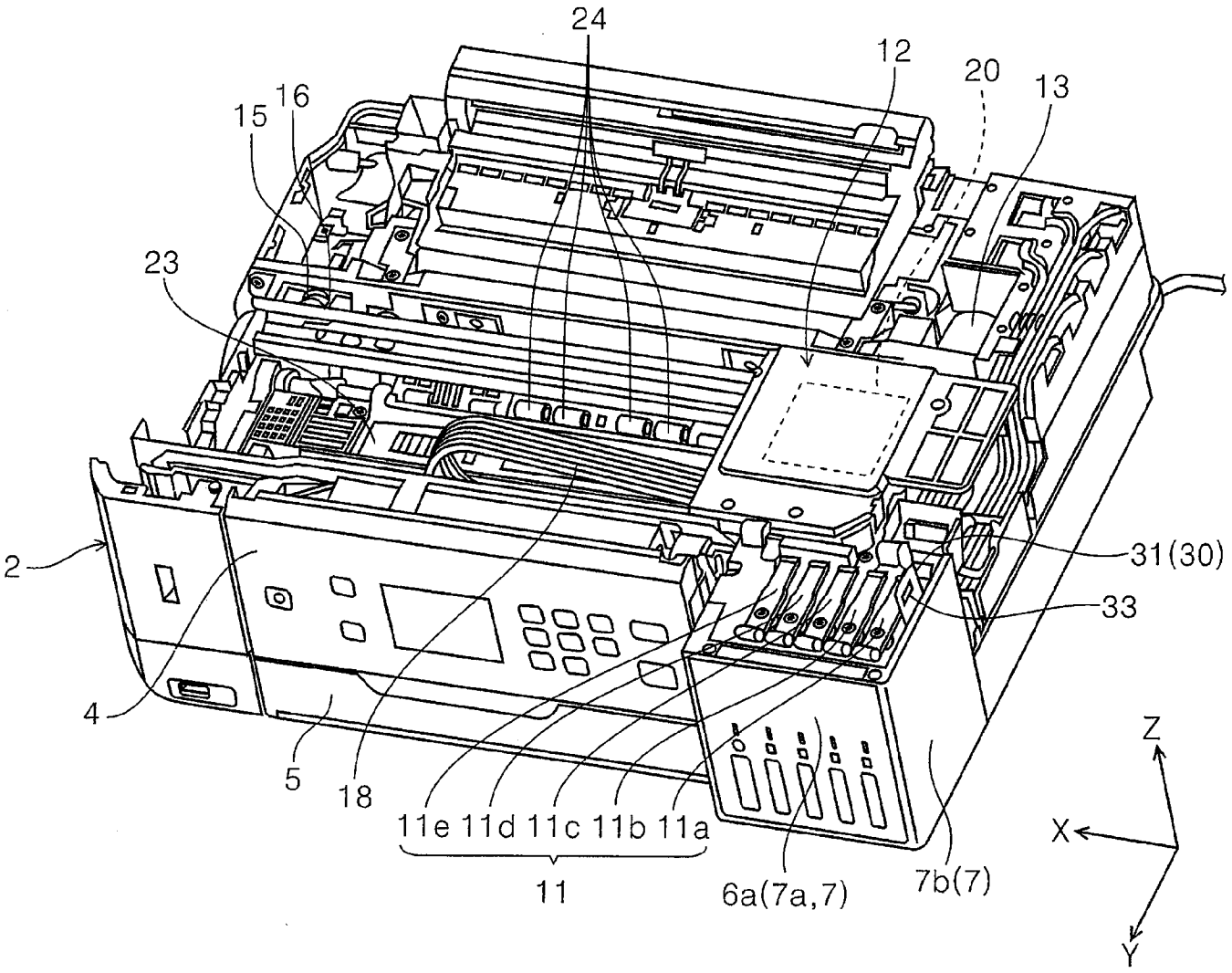
FIG. 4 is a perspective view for explaining a configuration of the apparatus main body.
Figure 5:
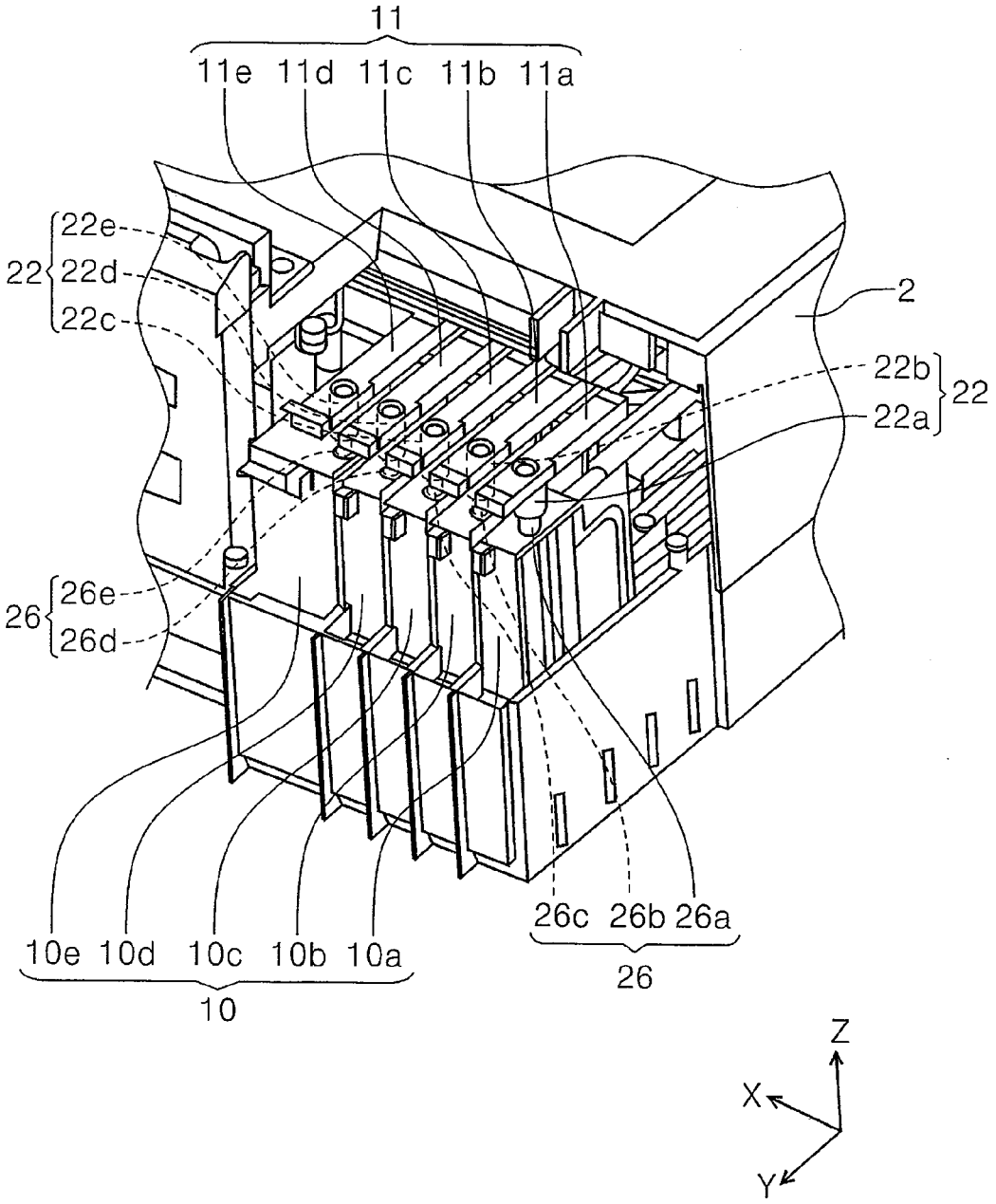
FIG. 5 is a diagram illustrating the state in which a unit cover, a housing, and a frame member are removed from a liquid storage unit.
Figure 6:
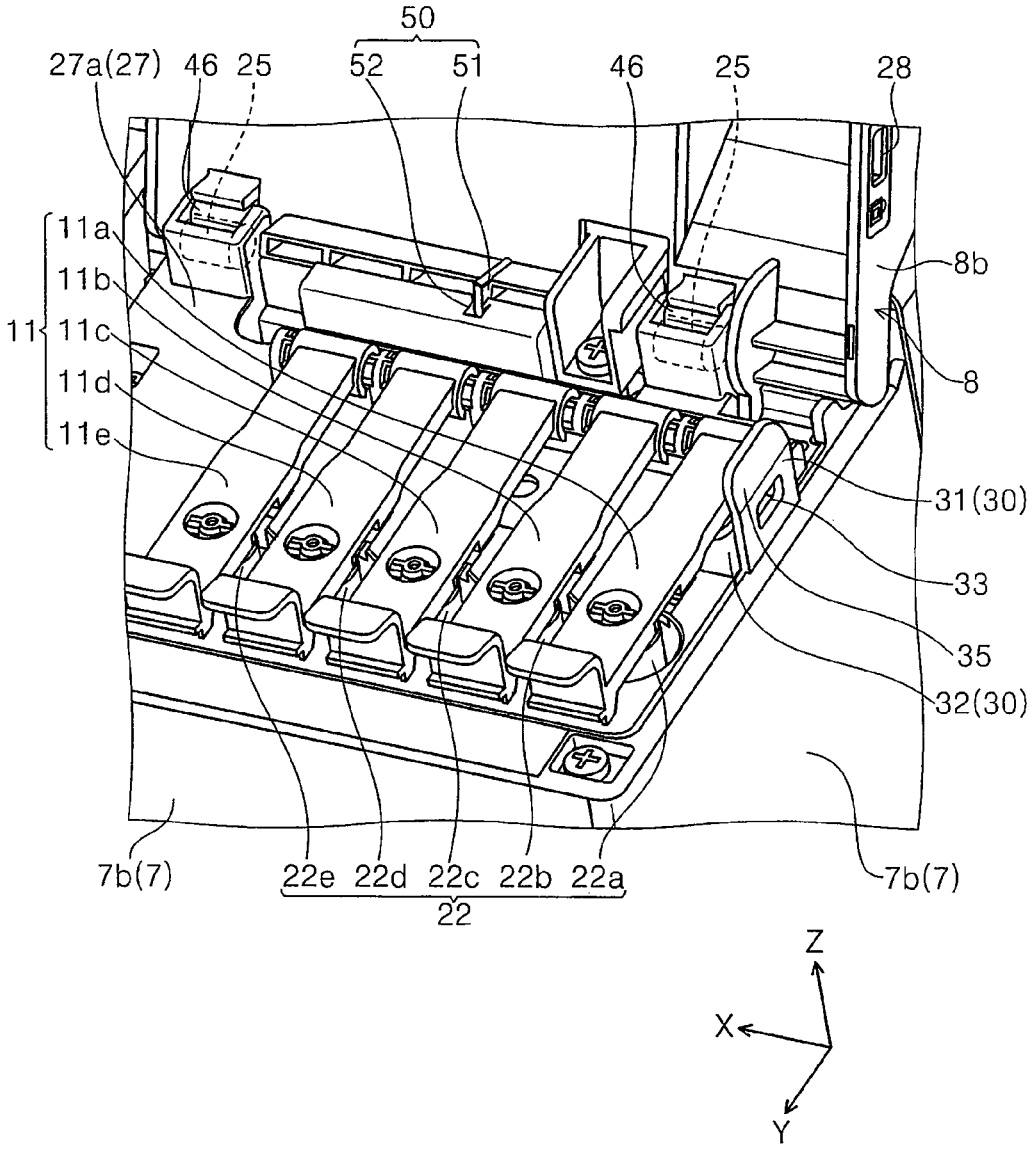
FIG. 6 is a main part enlarged view of the liquid storage unit when the unit cover is opened.
Figure 7:
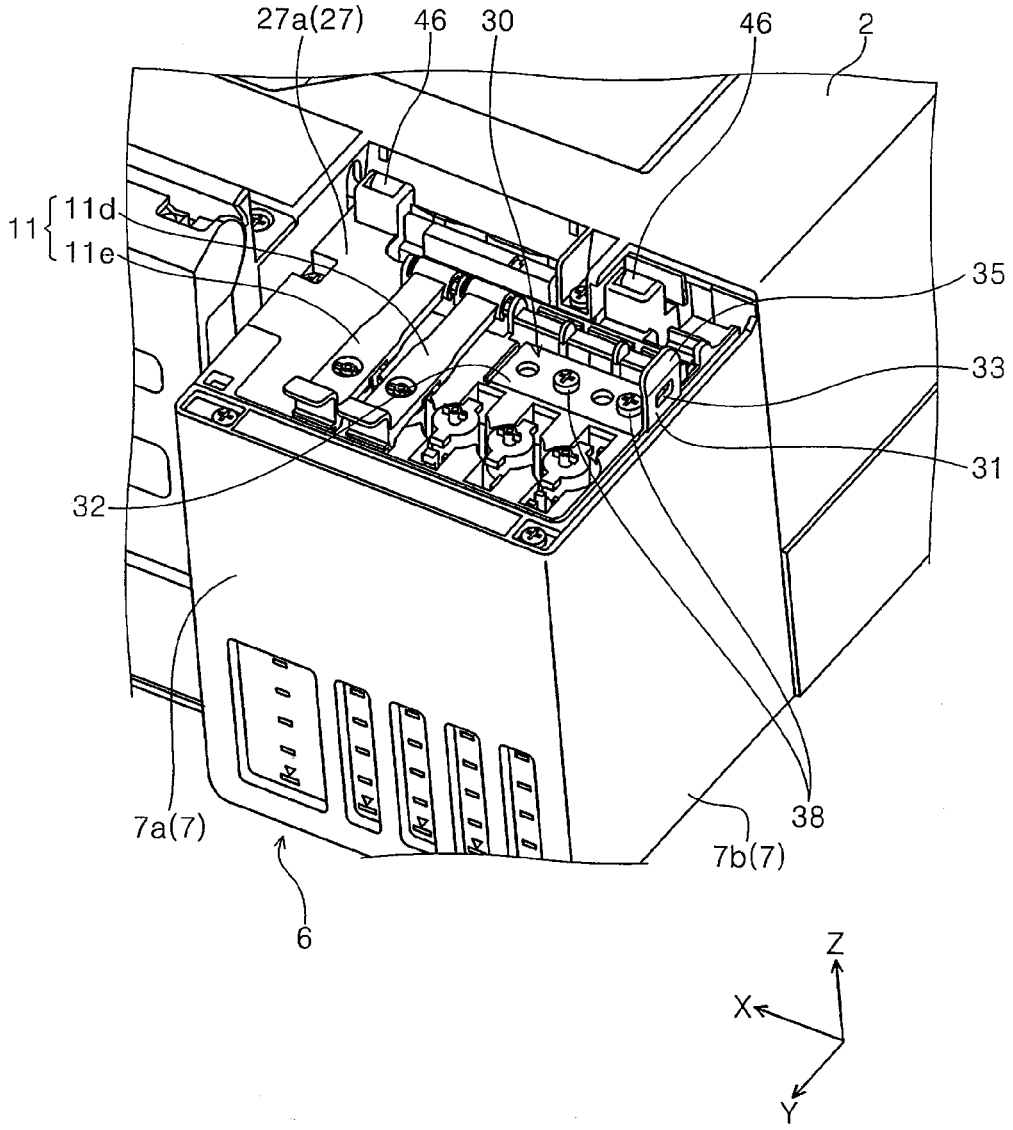
FIG. 7 is a diagram illustrating the state in which the unit cover is removed from the liquid storage unit.
Figure 8:
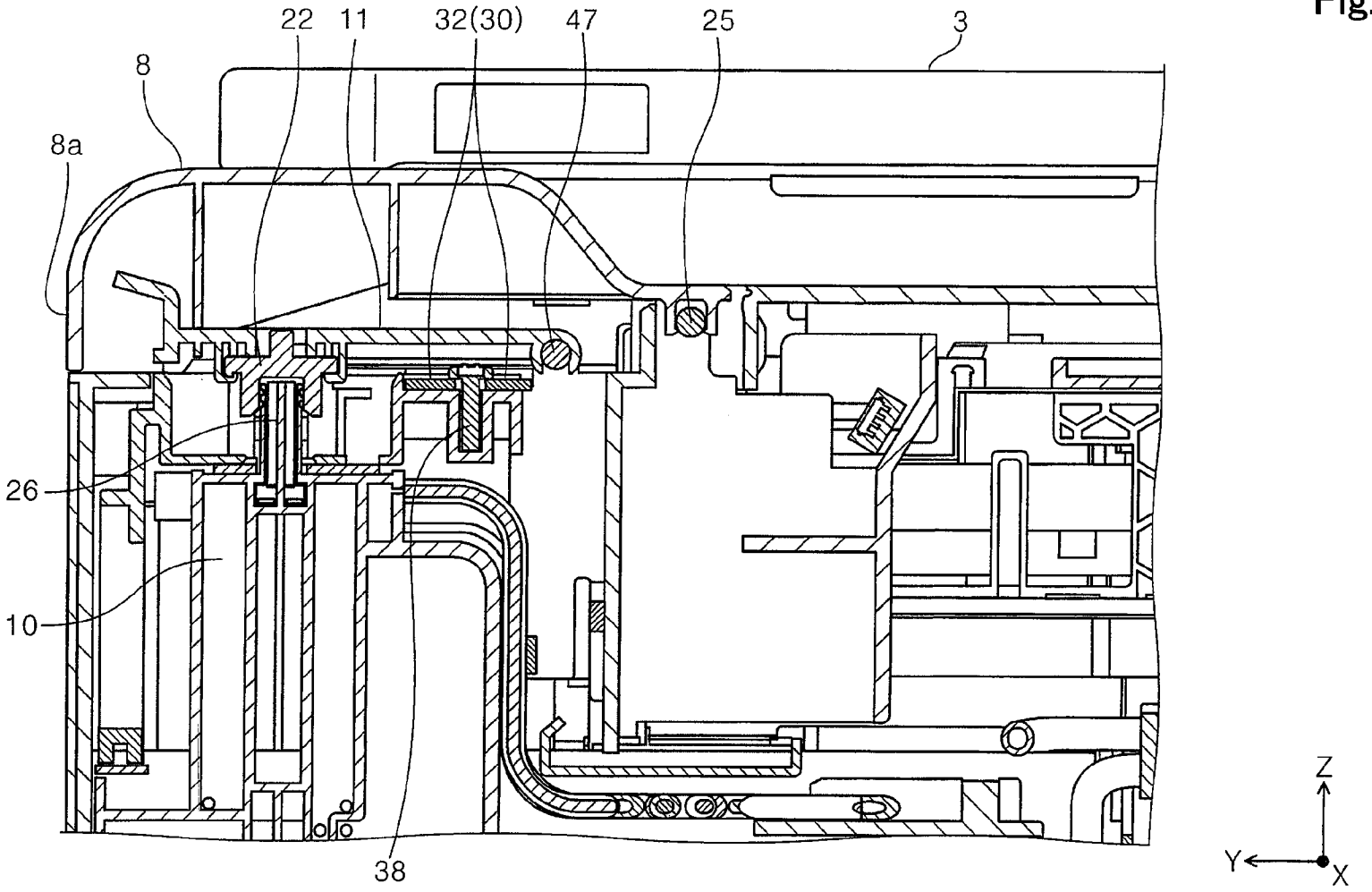
FIG. 8 is a side section view illustrating the liquid storage unit.
Figure 9:
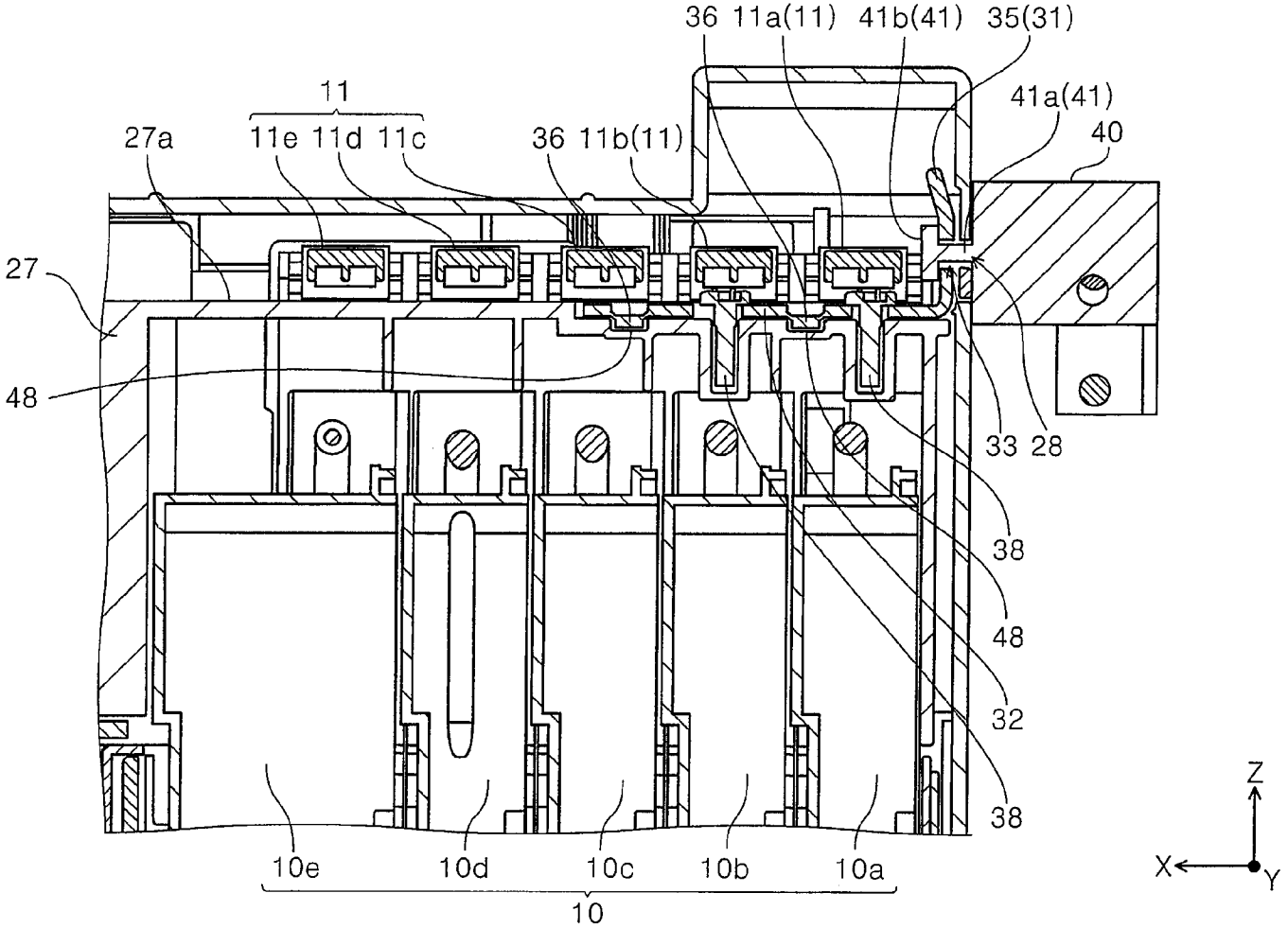
FIG. 9 is a front section view illustrating the liquid storage unit.
Figure 10:
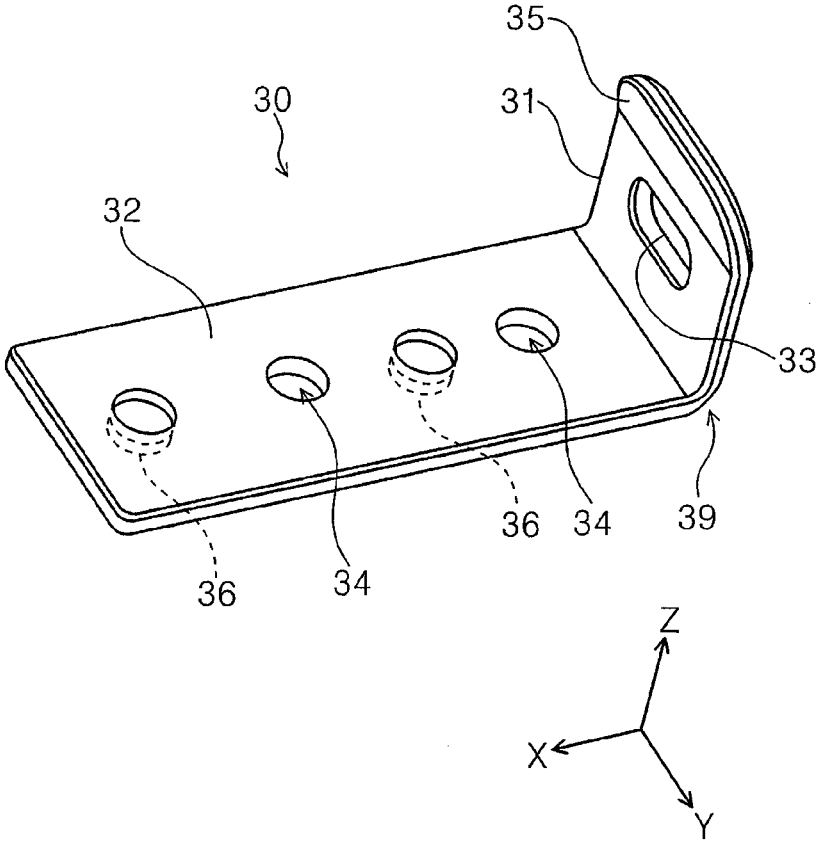
FIG. 10 is a perspective view of a locking part.

FIG. 1 is an external perspective view of a printer. FIG. 2 is an external perspective view of the printer when an operation panel is rotated to a front surface side of the apparatus. FIG. 3 is an external perspective view of the printer when a scanner and an ink tank cover are opened relative to the apparatus main body. FIG. 4 is a perspective view for explaining a configuration of the apparatus main body. FIG. 5 is a diagram illustrating the state in which a unit cover, a housing, and a frame member are removed from a liquid storage unit. FIG. 6 is a main part enlarged view of the liquid storage unit when the unit cover is opened. FIG. 7 is a diagram illustrating the state in which the unit cover is removed from the liquid storage unit. FIG. 8 is a side section view illustrating the liquid storage unit. FIG. 9 is a front section view illustrating the liquid storage unit. FIG. 10 is a perspective view of a locking part.

Figure 11:
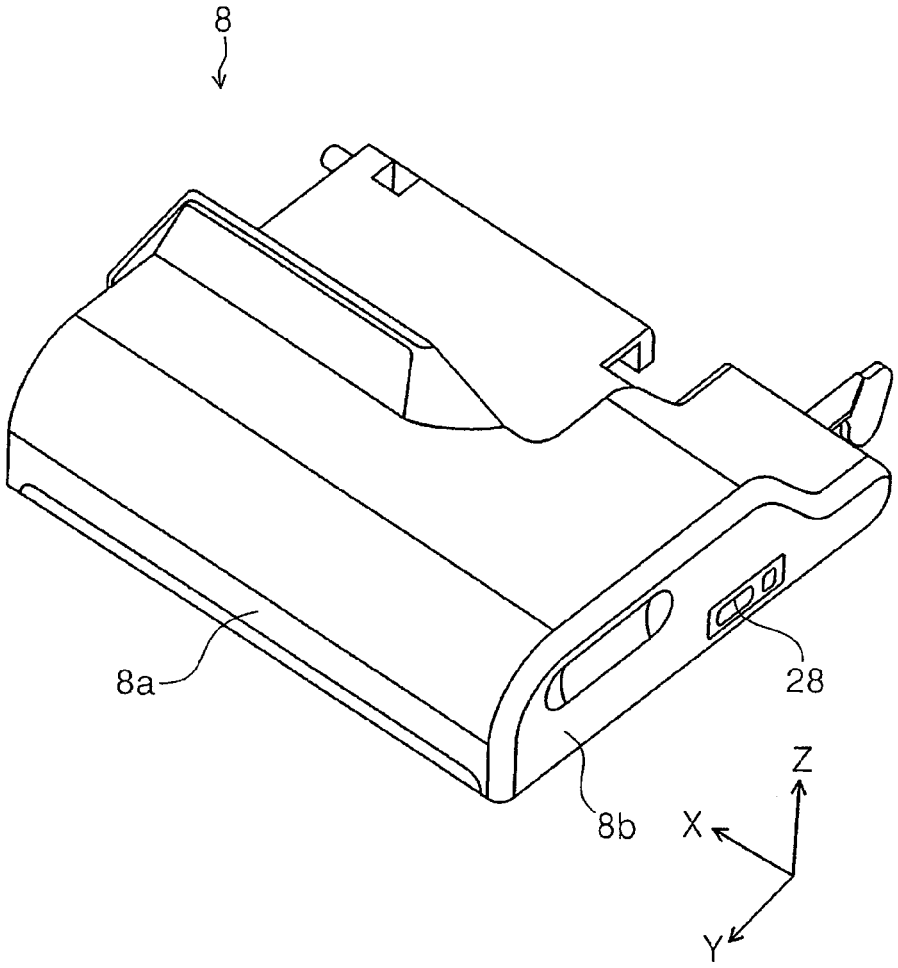
FIG. 11 is a perspective view of the unit cover.
Figure 12:
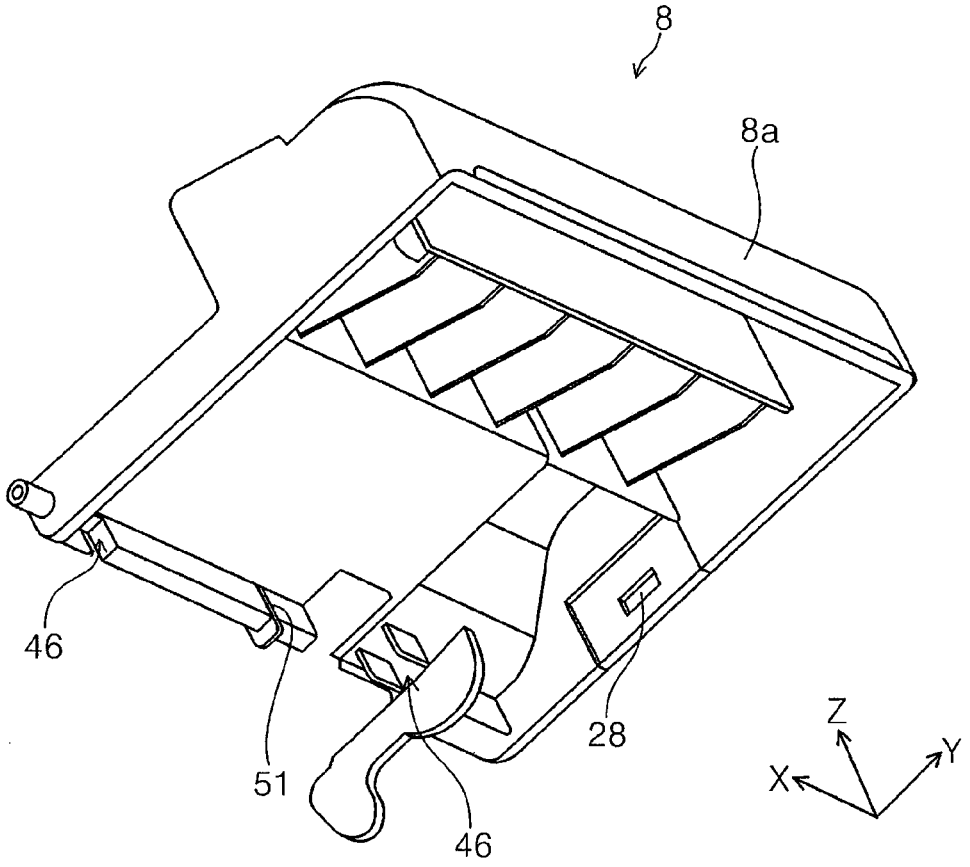
FIG. 12 is a perspective view of the unit cover illustrated in FIG. 11, viewed from another angle.
Figure 13:
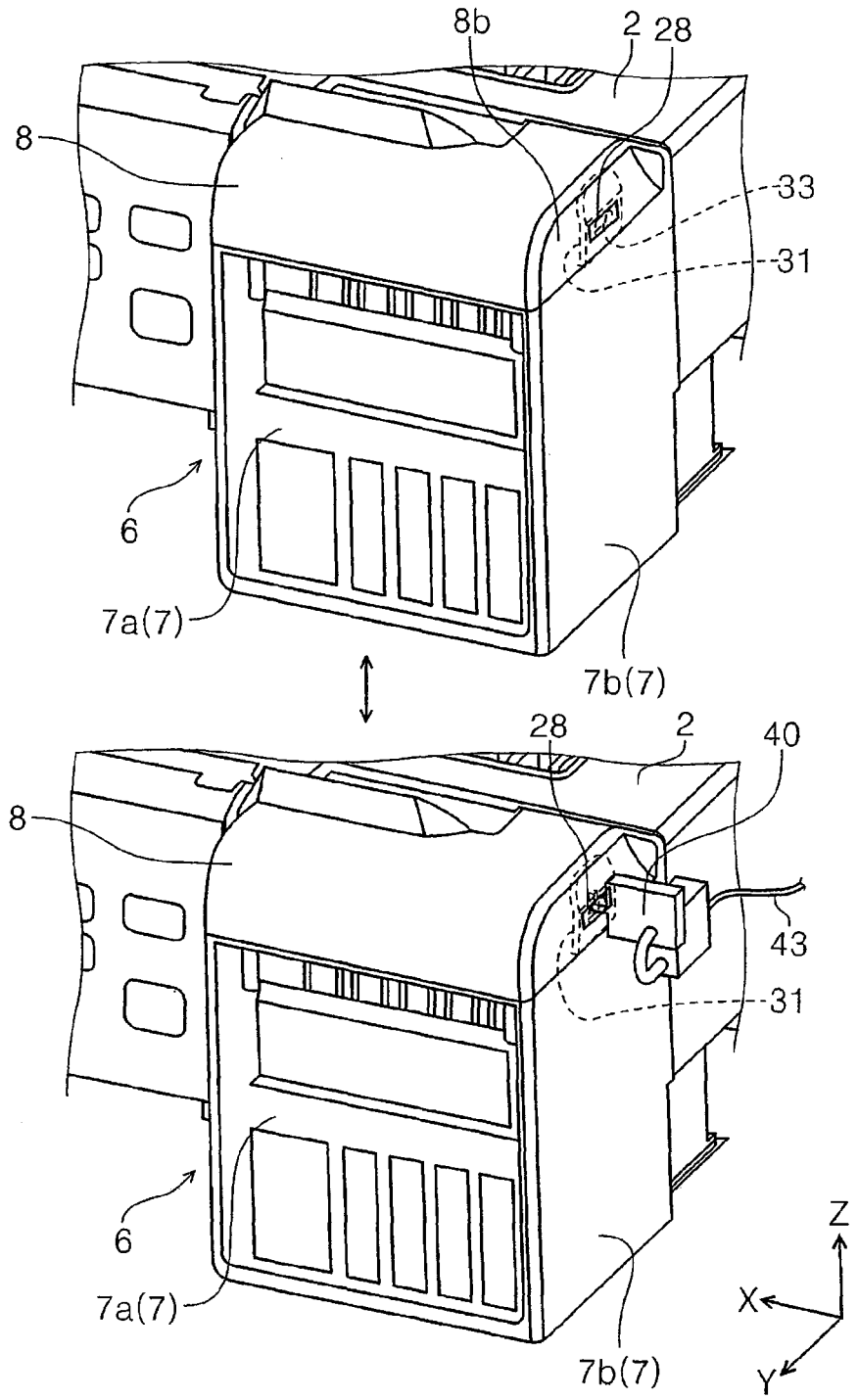
FIG. 13 is a diagram illustrating the state before and after the unit cover is locked by a locking member.
Figure 14:
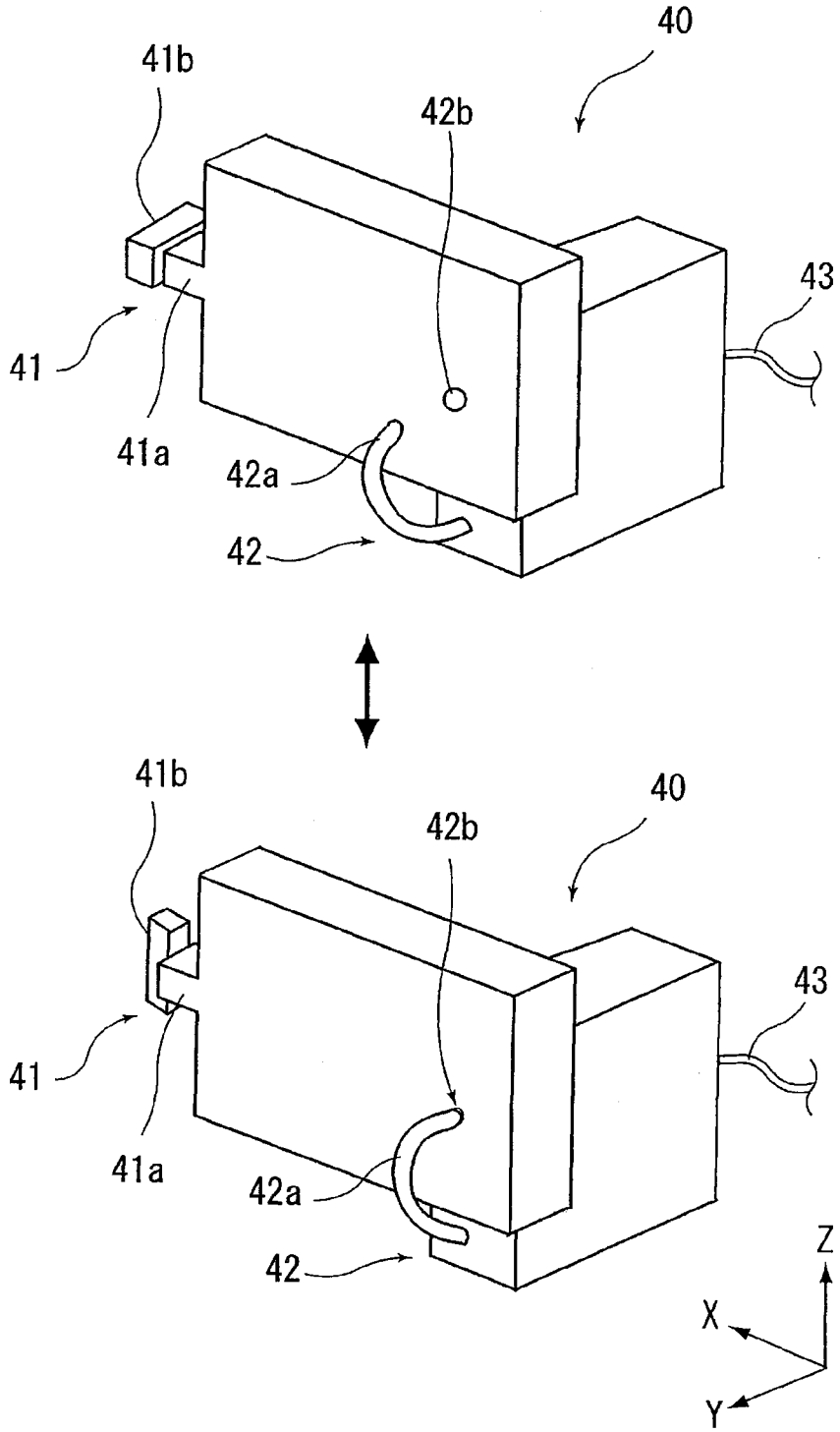
FIG. 14 is a diagram for explaining the locking member.
Figure 15:
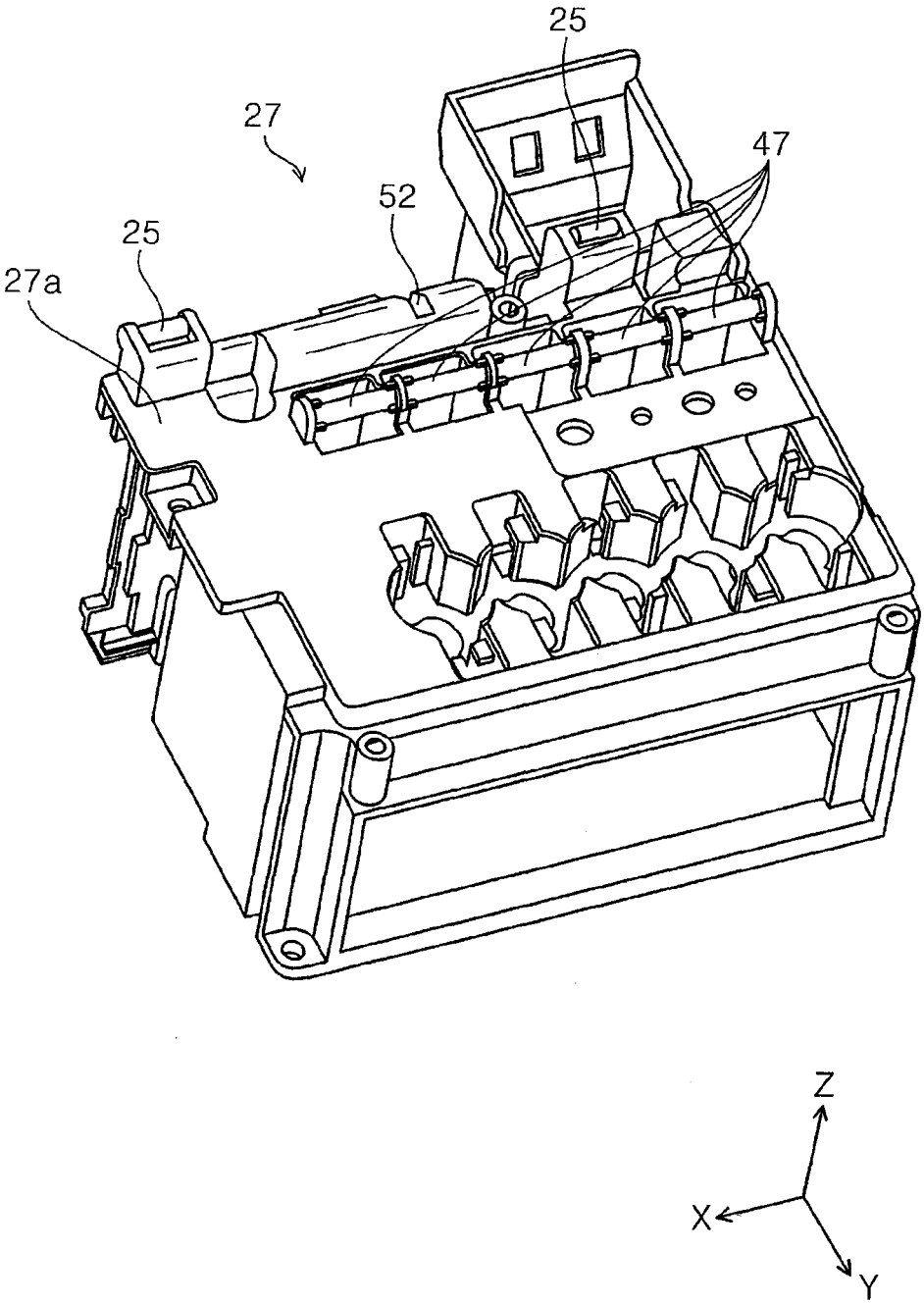
FIG. 15 is a perspective view illustrating the frame member.
Figure 16:
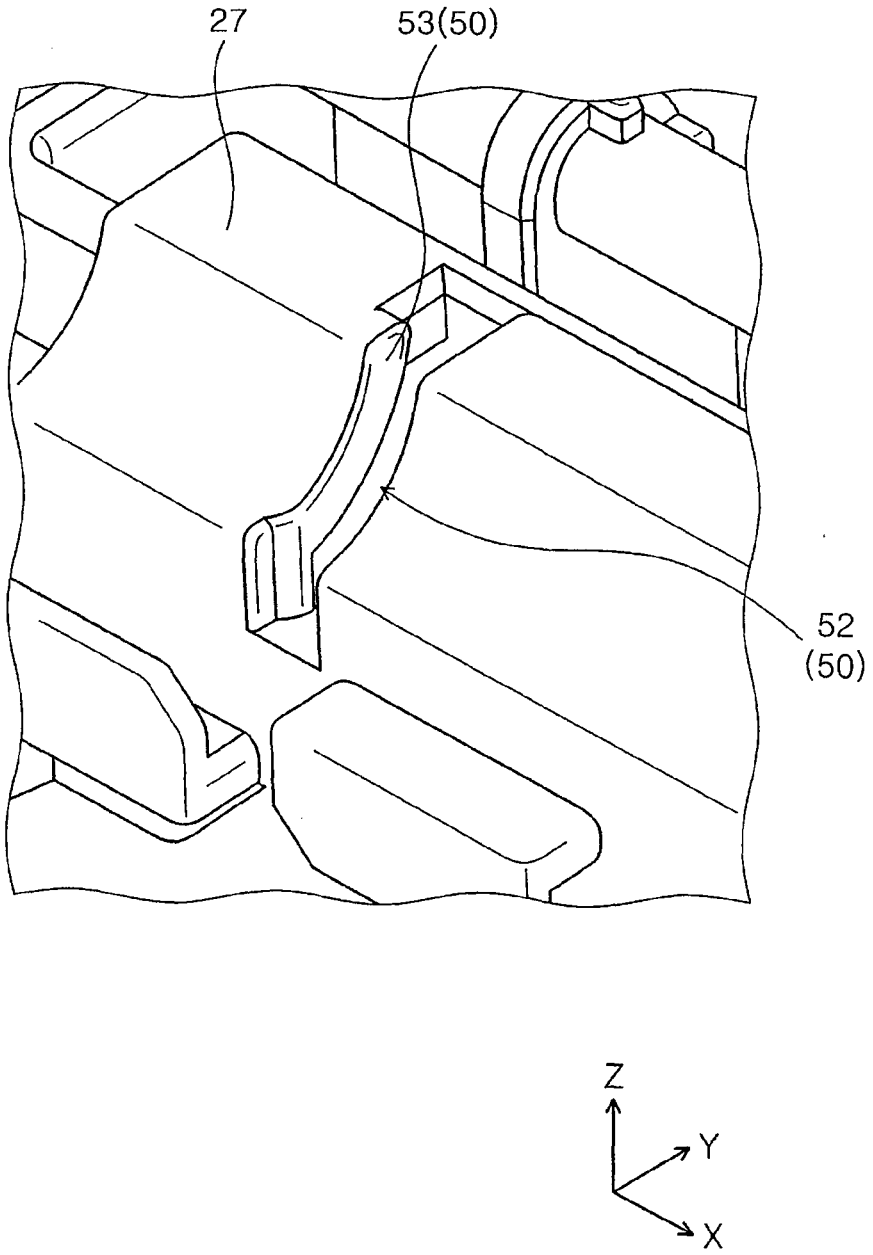
FIG. 16 is a main part enlarged perspective view illustrating the frame member.
Figure 17:
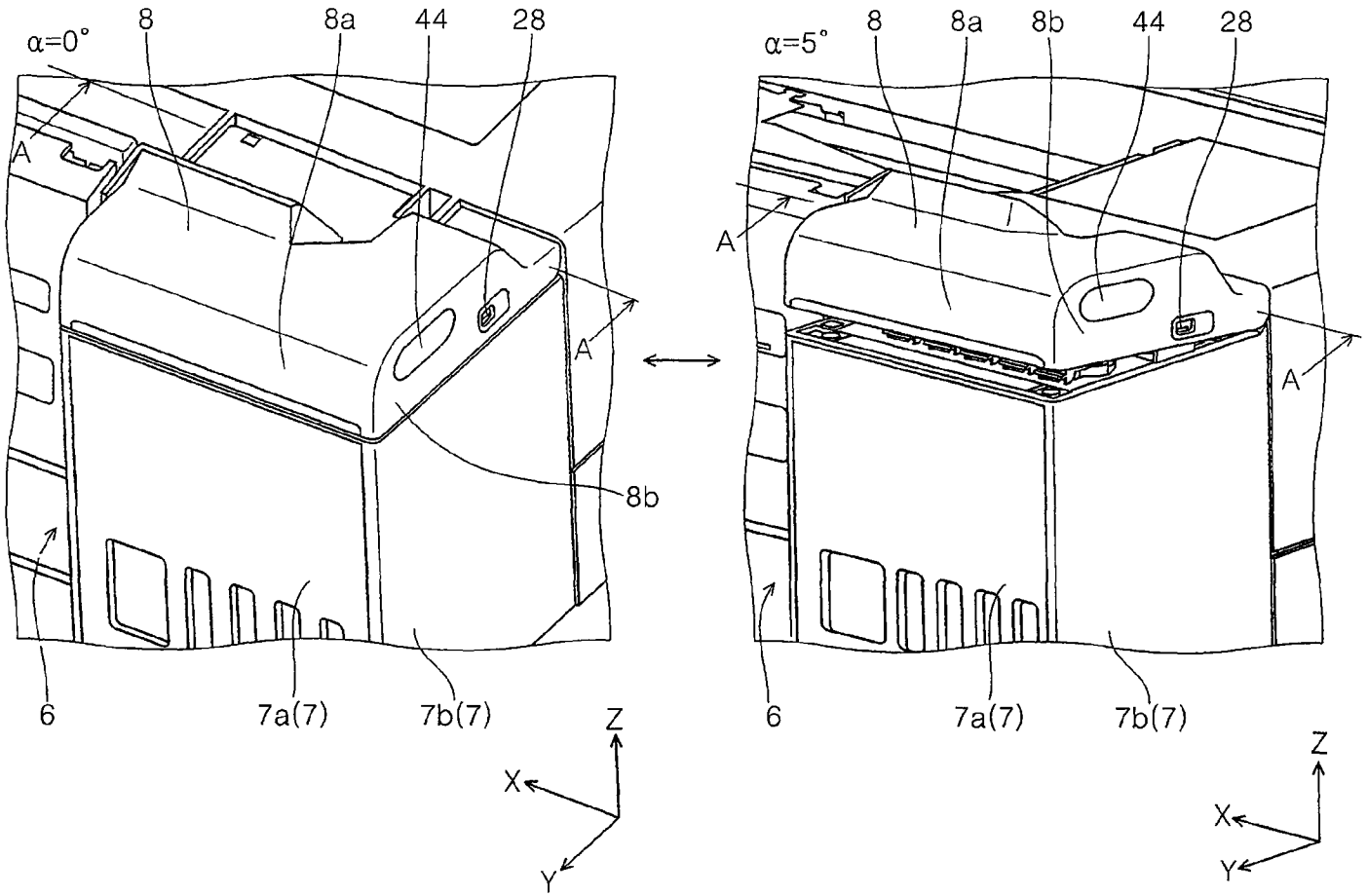
FIG. 17 is a diagram illustrating the states where an opening angle $\alpha$ of the unit cover is $\alpha=0°$ and $\alpha=5°$.
Figure 18:
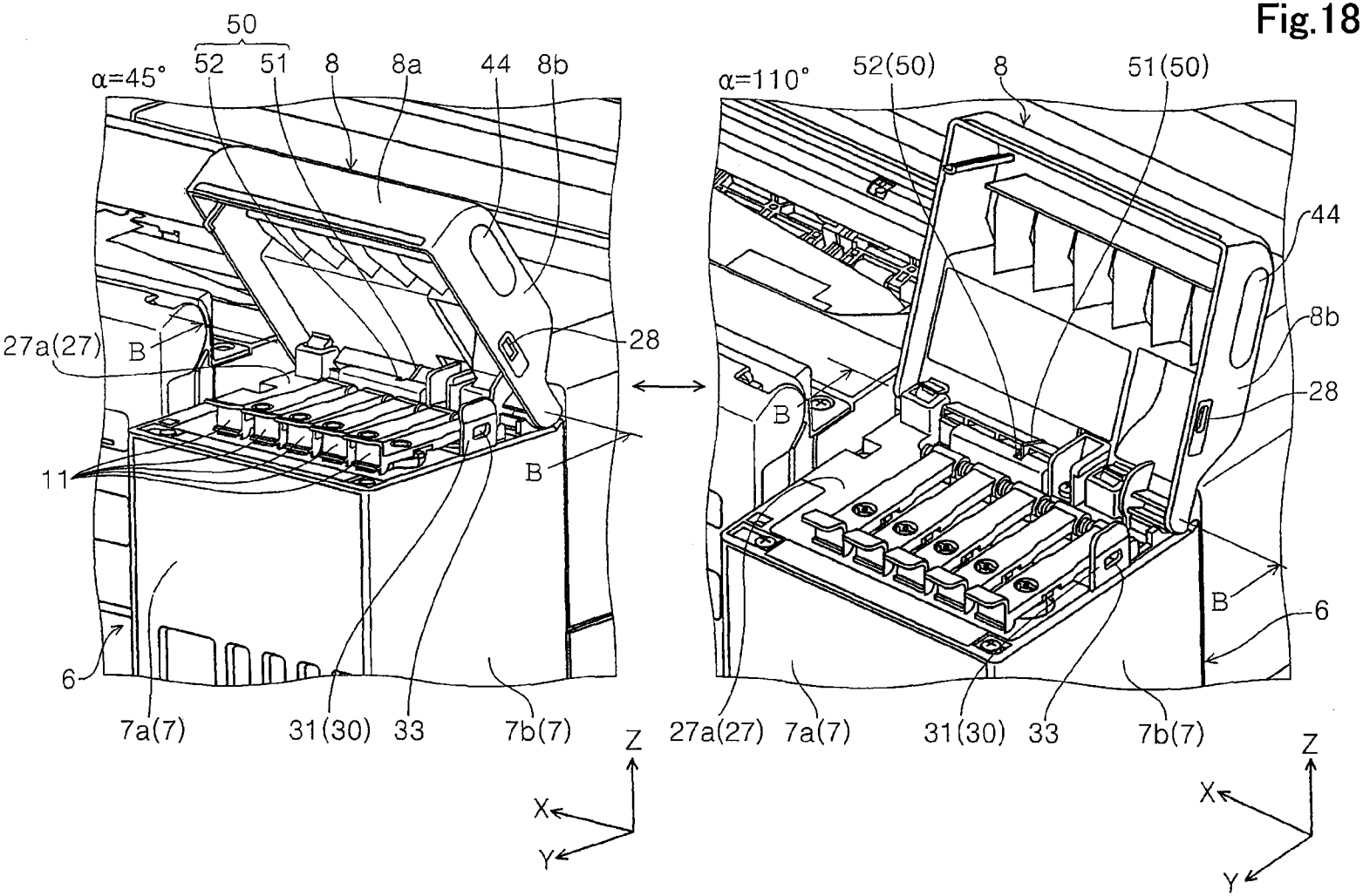
FIG. 18 is a diagram illustrating the states where an opening angle $\alpha$ of the unit cover is $\alpha=45°$ and $\alpha=110°$.
Figure 19:
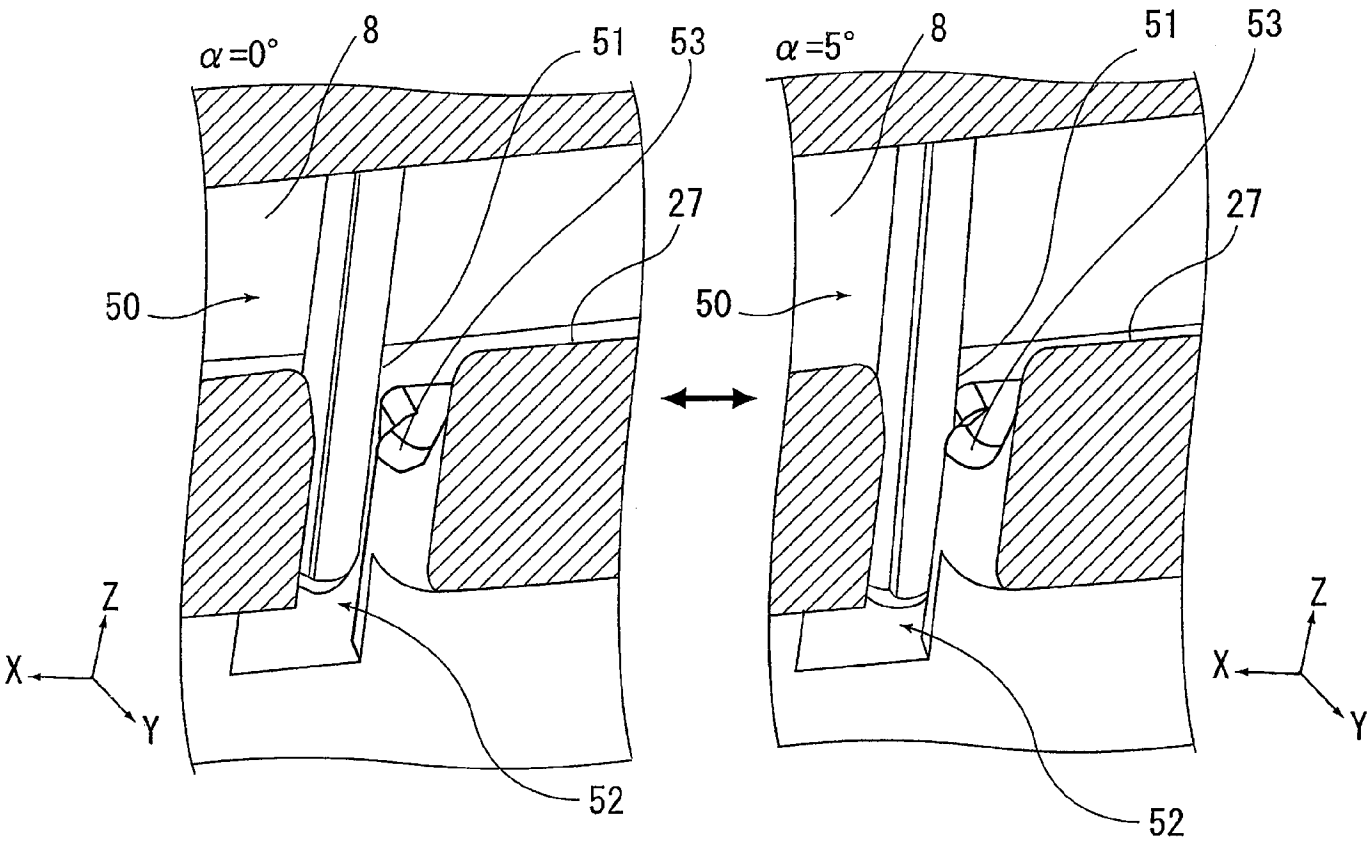
FIG. 19 is a perspective section view taken from A-A of FIG. 17.
Figure 20:
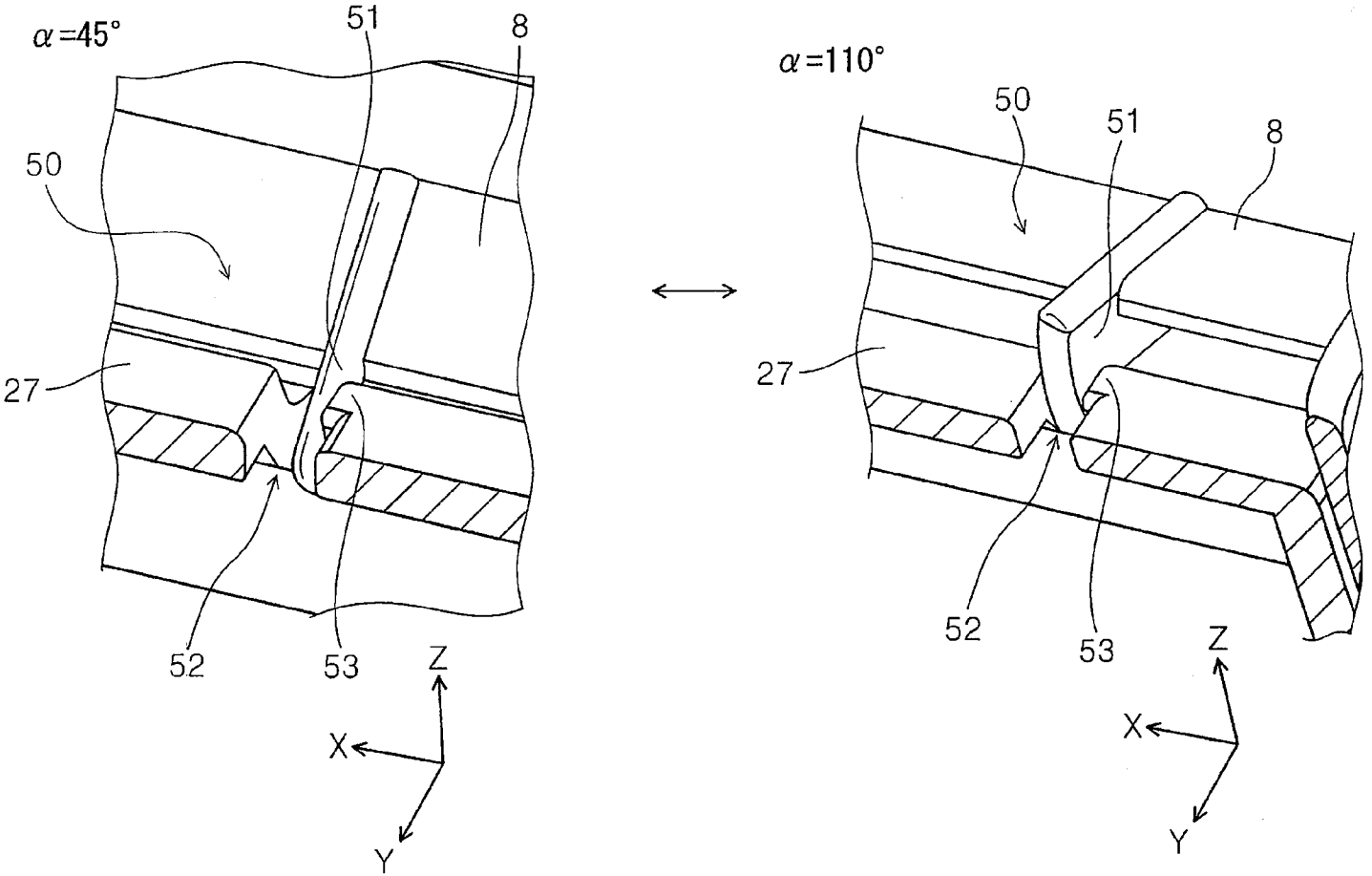
FIG. 20 is a perspective section view taken from B-B of FIG. 18.
Figure 21:
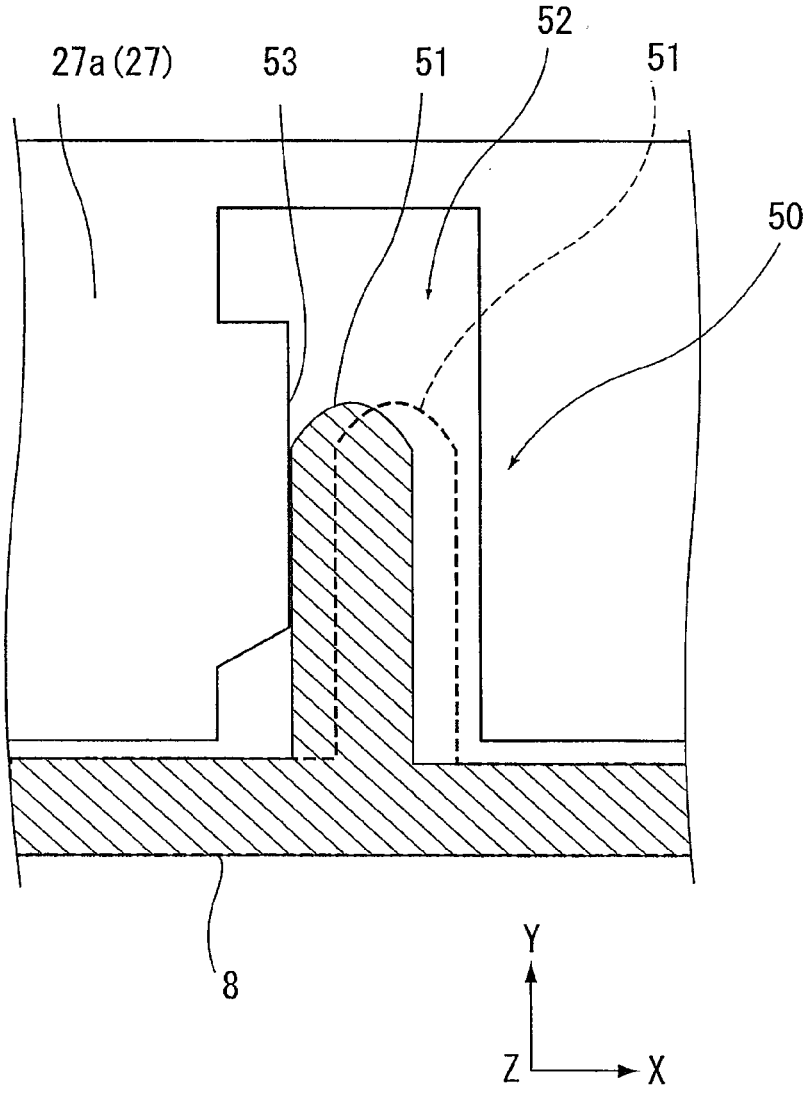
FIG. 21 is a diagram for explaining a damper mechanism.

FIG. 11 is a perspective view of the unit cover. FIG. 12 is a perspective view of the unit cover illustrated in FIG. 11, viewed from another angle. FIG. 13 is a diagram illustrating the state before and after the unit cover is locked by a locking member. FIG. 14 is a diagram for explaining the locking member. FIG. 15 is a perspective view illustrating the frame member. FIG. 16 is a main part enlarged perspective view illustrating the frame member. FIG. 17 is a diagram illustrating the states where an opening angle $\alpha$ of the unit cover is $\alpha=0°$ and $\alpha=5°$. FIG. 18 is a diagram illustrating the states where an opening angle $\alpha$ of the unit cover is $\alpha=45°$ and $\alpha=110°$. FIG. 19 is a perspective section view taken from A-A of FIG. 17. FIG. 20 is a perspective section view taken from B-B of FIG. 18. FIG. 21 is a diagram for explaining a damper mechanism.

In an X-Y-Z coordinate system illustrated in each diagram, an X axis direction indicates a width direction of a recording device and a moving direction of a recording head, a Y axis direction indicates a depth direction of the recording device and a medium conveyance direction, and a Z axis direction indicates an apparatus height direction. In each diagram, the +X axis direction side corresponds to a left side of the apparatus, the −X axis direction side corresponds to a right side of the apparatus, the +Y axis direction side corresponds to a front surface side of the apparatus, the −Y axis direction side corresponds to a back surface side of the apparatus, the +Z axis direction side corresponds to an upper side of the apparatus, and the −Z axis direction side corresponds to a lower side of the apparatus.

Entire Configuration of Printer

The following will schematically describe an entire configuration of the printer 1. The printer 1 (FIG. 1) includes an apparatus main body 2 with a recording head 20 (FIG. 4) as the "liquid ejection part", and a scanner unit 3 that is provided on the upper part of the apparatus main body 2 and reads out documents. The recording head 20 is provided on the lower part of a carriage unit 12 (FIG. 4).

On the apparatus front surface side of the printer 1 of FIG. 1, a symbol 4 indicates an operation panel 4 configured including a power button, operation buttons for performing various printing settings and recording, a display part performing preview display of printing setting contents and printing images, and the like. The operation panel 4 is rotatably attached to the apparatus front surface side of the apparatus main body 2, as illustrated in FIG. 2.

When the operation panel 4 is rotated, as illustrated in FIG. 2, a medium discharge tray 9 stored in the apparatus main body 2 is movable forward. The medium discharge tray 9 is configured to be movable forward and backward between a position stored in the apparatus main body 2 (see a solid line in FIG. 2) and a position pulled out to the apparatus front surface side from the apparatus main body 2 (see a double-dashed line in FIG. 2).

On the apparatus lower side of the medium discharge tray 9 in the apparatus main body 2, there is attached a medium storage part 5 storing a medium so as to be insertable and removable from the apparatus front surface side relative to the apparatus main body 2.

The scanner unit 3 provided on the upper part of the apparatus main body 2 is configured to be rotatable relative to the apparatus main body 2 as illustrated in FIG. 3, and may switch its posture between a posture closed relative to the apparatus main body 2 (see FIG. 1 and FIG. 2) and a posture opened relative to the apparatus main body 2 (see FIG. 3).

In FIG. 1 to FIG. 4, a liquid storage unit 6 is provided on the apparatus front surface side and the apparatus right side end of the apparatus main body 2. The liquid storage unit 6 includes a plurality of ink tanks 10*a*, 10*b*, 10*c*, 10*d*, 10*e* (see FIG. 5, hereinafter, referred to as an ink tank 10 when each of the ink tanks 10*a* to 10*e* is not necessarily distinguished from another) as a "liquid storage part" storing ink of each color as "liquid" supplied to the recording head 20, a housing 7 housing therein the ink tank 10, and a unit cover 8 as a "first opening/closing body" rotatably attached to the housing 7. In the apparatus main body 2, the liquid storage unit 6 is provided independently from the carriage unit 12 (FIG. 4). The liquid storage unit 6 will be further described later.

In FIG. 4, the carriage unit 12 including the recording head 20 at the lower part thereof is arranged on the back surface side (−Y axis direction) of the liquid storage unit 6. As an example, the carriage unit 12 is configured to be reciprocatable in the apparatus width direction (X axis direction) as a scanning direction in the apparatus main body 2. Explaining the drive mechanism of the carriage unit 12 more concretely, a drive motor 13 is provided on the back surface side (−Y axis direction) of the carriage unit 12 in the apparatus depth direction.

A drive pulley (on the apparatus front surface side of the drive motor 13 (not viewed in FIG. 4)) is provided on a drive axis of the drive motor 13. In the apparatus main body 2 illustrated in FIG. 4, a driven pulley 15 is provided at a position spaced in the apparatus width direction from the drive pulley (not illustrated). The driven pulley 15 is provided to be capable of driven rotation relative to the drive pulley. An endless belt 16 is extended around the drive pulley and the driven pulley 15. Then, at least one part of the endless belt 16 is attached to the carriage unit 12 on the back surface side of the carriage unit 12.

Once the drive motor 13 is driven and rotated, the endless belt 16 is driven and rotated, which moves the carriage unit 12 attached on the endless belt 16 in the X axis direction. For example, a position of the carriage unit 12 illustrated in FIG. 4 in the apparatus main body 2 is set as a home position of the carriage unit 12.

In the carriage unit 12 illustrated in FIG. 4, there are attached, corresponding to the ink tanks 10, a plurality of relay adapters (not illustrated) relaying supply of ink to the recording head 20 from the ink tank 10. The relay adapters are connected to the ink tank 10 through ink supply tubes 18, and configured to be able to supply ink to nozzles (not illustrated) provided in the recording head 20.

In FIG. 4, a medium supporting member 23 extending in the apparatus width direction is provided on the lower part of the recording head 20. A pair of conveying rollers 24 are provided on the back surface side of the medium supporting member 23.

Explaining recording operation of the printer 1 on a medium with reference mainly to FIG. 4, a medium stored in the medium storage part 5 is fed to the conveying rollers 24 by a feeding means (not illustrated). Then, the conveying rollers 24 nip the medium and feed the medium to an area facing the recording head 20 on the lower side of the recording head 20. Then, the medium supported by the medium supporting member 23 receives, on the surface facing the recording head 20, ink ejected from the nozzles (not illustrated) of the recording head 20. In this manner, recording is performed on the surface facing the recording head 20 in the medium. Thereafter, the recorded medium is discharged to the medium discharge tray 9 (FIG. 2) projecting on the apparatus front surface side of the apparatus main body 2.

Overview of Configuration of Liquid Storage Unit

The following will describe a detailed configuration of the liquid storage unit 6.

The liquid storage unit 6 provided on the front surface side of the printer 1 is arranged at a position on the lower side of the scanner unit 3 in a posture at least partially closed in the apparatus width direction (X axis direction), as illustrated in FIG. 1.

As illustrated in FIG. 3, when the scanner unit 3 is in a posture opened relative to the apparatus main body 2, the unit cover 8 is exposed totally, allowing opening of the unit cover 8.

The unit cover 8 is rotatably fixed to the housing 7 side on which the ink tank 10 is provided, with a rotation axis 25 (FIG. 6) provided on the back surface side (−Y axis direction) of the housing 7 as an axis, so as to open and close the upper part of an ink injection port 26 (FIG. 5).

To be specific, the unit cover 8 is attached on an upper surface 27*a* of a frame member 27 (see also FIG. 15) provided in the housing 7 (FIG. 6). The ink tank 10 is arranged on the inner side of the frame member 27 in the housing 7.

Although the ink injection port 26 is provided on the upper surface 27*a* side of the frame member 27 in the embodiment, the ink injection port 26 may be provided to direct at the apparatus front surface side, for example.

The ink tank 10 is configured to allow ink to be injected from a refilling container (not illustrated). When the unit cover 8 (first opening/closing body) is opened, as illustrated in FIG. 3, an injection port cover 11 as a "second opening/closing body" (see also FIG. 5 and FIG. 6) is exposed. Injection port covers 11*a*, 11*b*, 11*c*, 11*d*, 11*e* (FIG. 5 and FIG. 6) are covers sealing ink injection ports 26*a*, 26*b*, 26*c*, 26*d*, 26*e* (ink injection port 26) provided in the ink tanks 10*a*, 10*b*, 10*c*, 10*d*, 10*e* of each color illustrated in FIG. 5, and are provided for the ink injection ports 26*a*, 26*b*, 26*c*, 26*d*, 26*e*, respectively.

The injection port covers 11*a*, 11*b*, 11*c*, 11*d*, 11*e* include cap parts 22*a*, 22*b*, 22*c*, 22*d*, 22*e* (cap portion 22) opening and closing the ink injection ports 26*a*, 26*b*, 26*c*, 26*d*, 26*e*.

The injection port cover 11 includes a rotation axis 47 (FIG. 8) on the back surface side (−Y axis direction), and is rotatably attached to the ink tank 10. The injection port cover 11 is opened, which allows attachment of a refilling container to the ink injection port 26, and then refilling of ink. Then, the injection port cover 11 is covered by the closed unit cover 8 in the state where the ink injection port 26 is closed.

In the embodiment, five ink tanks 10 are provided, as illustrated in FIG. 5. Each ink tank 10 contains each ink of black, magenta, yellow, cyan, and photo black, for example. The liquid storage unit 6 includes, on the front surface 7*a* side of the housing 7, a display part 6*a* (FIG. 1) allowing confirmation of an ink residual amount in each ink tank 10. The liquid storage unit 6 does not necessarily include a plurality of ink tanks 10 as long as it includes at least one ink tank 10.

Locking Mechanism of Liquid Storage Unit

The liquid storage unit 6 is configured to be lockable in the state where the unit cover 8 is closed relative to the housing 7 (hereinafter, also referred to as a closed state). The following will describe a locking mechanism of the unit cover 8.

The locking mechanism of the unit cover 8 is configured such that with the unit cover 8 closed, a first insertion hole 28 (FIG. 6) provided on the unit cover 8 side overlaps with a second insertion hole 33 (FIG. 6) provided on the housing 7 side (upper diagram of FIG. 13), to which a locking member 40 is inserted and locked, as illustrated in the lower diagram of FIG. 13.

The following will describe the locking member 40 inserted into the first insertion hole 28 and the second insertion hole 33, and then further the first insertion hole 28 and the second insertion hole 33.

Locking Member

The following will describe, with reference to FIG. 14, the locking member 40 inserted into the first insertion hole 28 and the second insertion hole 33 in the state where the unit cover 8 is closed.

In the locking member 40 illustrated in FIG. 14, an insertion part 41 includes a base 41*a* and an end 41*b* rotating relative to the base 41*a* in accordance with opening and closing of a locking part 42 described later. The base 41*a* has a form corresponding to the first insertion hole 28 and the second insertion hole 33, when viewed along the X axis direction that is an insertion/extraction direction.

To be more specific, as illustrated in FIG. 6, the first insertion hole 28 and the second insertion hole 33 have a form elongate in the apparatus depth direction (Y axis direction), and the base 41*a* of the locking member 40 (FIG. 14) has a form elongate in the Y axis direction allowing insertion and extraction into/from the overlapped first insertion hole 28 and the second 33 with the unit cover 8 closed. The end 41*b* similarly has a bar form elongate in the Y axis direction allowing insertion and extraction into/from the first insertion hole 28 and the second insertion hole 33 in the state of the upper diagram of FIG. 14.

The locking part 42 may be in a closed state in which one end of a hook part 42*a* is fit in a fitting part 42*b* (lower diagram of FIG. 14), and an opened state in which one end of the hook part 42*a* is removed from the fitting part 42*b* (upper diagram of FIG. 14).

The longitudinal direction of the end 41*b* directs at the Y axis direction when the locking part 42 of the locking member 40 is open (upper diagram of FIG. 14), which allows the insertion part 41 to be inserted and extracted into/from the first insertion hole 28 and the second insertion hole 33 (upper diagram of FIG. 13).

Once the locking part 42 of the locking member 40 is closed, the end 41*b* is rotated so that the longitudinal direction thereof directs at the Z axis direction, as illustrated in the lower diagram of FIG. 14. This state disables the end 41*b* to be inserted and extracted into/from a hole elongate in the Y axis direction.

In order to lock the unit cover 8 relative to the housing 7, the locking part 42 of the locking member 40 is open (upper diagram of FIG. 14), and the insertion part 41 is inserted to the first insertion hole 28 and the second insertion hole 33 (upper diagram of FIG. 13) Then, in such a state, the locking part 42 of the locking member 40 is closed (lower diagram of FIG. 14), whereby the end 41*b* is not extracted from the first insertion hole 28 and the second insertion hole 33 in a locked state (lower diagram of FIG. 13).

When the unit cover 8 is closed and locked relative to the housing 7, it is possible to avoid a possibility that the unit cover 8 is opened unnecessarily.

The locking part 42 of the locking member 40 may be opened and closed by a key part (not illustrated), or by various methods such as a dial method, a push button method, and a digital method. Although in FIG. 14 the locking part 42 is illustrated as a padlock facilitating recognition of the opening/closing state of the lock, it is natural that the locking part 42 is not limited thereto.

As the locking member 40, a security wire with a key for electronics (also referred to as a security wire lock), for example, may be used. One side end of a wire 43 (FIG. 13 and FIG. 14) is connected to the locking member 40, and the other side end of the wire 43 is connected to a fixing part (including furniture such as a desk that is not easily movable) (not illustrated), which prevents the printer 1 with the liquid storage unit 6 locked by the locking member 40 from moving out of a given range.

When the object is only to lock the unit cover 8 to the housing 7, the locking member 40 may not include the wire 43.

First Insertion Hole and Second Insertion Hole

The following will describe configurations of the first insertion hole 28 and the second insertion hole 33 in the locking mechanism of the liquid storage unit.

The unit cover 8 includes the first insertion hole 28 through which the locking member 40 is insertable (FIG. 6, FIG. 13).

On the housing 7 side where the ink tank 10 is stored, there is provided a locking part 30 (FIG. 6) locking the closed unit cover 8 and keeping the closed state. As illustrated in the upper diagram of FIG. 13, the locking part 30 is provided at a position facing the first insertion hole 28 in an area covered by the closed unit cover 8, and includes the second insertion hole 33 through which the locking member 40 is insertable. That is, the locking part 30 is provided on the inner side of the opening of the upper part of the housing 7.

The liquid storage unit 6 of the embodiment is configured so that the unit cover 8 is closed relative to the housing 7 in the state where an end of a peripheral wall of the unit cover 8 is butted against an end of a peripheral wall of the housing 7. That is, as illustrated in FIG. 1, a front surface 8*a* and a right side surface 8*b* as peripheral walls of the unit cover 8, and a front surface 7*a* and a right side surface 7*b* as peripheral walls of the housing 7 are configured to be flush. A back surface and a left side surface of each of the unit cover 8 and the housing 7 are also flush, although they are not viewed in FIG. 1.

In the locking part 30, at least a part including the second insertion hole 33 is provided to project from the housing 7 in the height direction (Z axis direction), as illustrated in FIG. 6. To be more specific, a tongue-piece part 31 (also refer to FIG. 10) including the second insertion hole 33 in the locking part 30 projects from the housing 7 in the height direction.

As described above, the locking part 30 including the second insertion hole through which the locking member 40 is insertable is provided at a position facing the first insertion hole 28 in the area covered by the closed unit cover 8, which enables an appearance in which the first insertion hole 28 and the second insertion hole 33 do not project from the liquid storage unit 6 in the closed unit cover 8 (FIG. 1 and upper diagram of FIG. 13). Therefore, when the locking member 40 is not inserted in the first insertion hole 28 and the second insertion hole 33, the liquid storage unit 6 has a compact and simple appearance excellent in designability.

Moreover, the first insertion hole 28 and the second insertion hole 33 do not project in the appearance, which reduces a possibility that an object is externally brought into contact.

In the embodiment, the first insertion hole 28 is provided on the right side surface 8*b* as a "side surface portion" on one side in the width direction (X axis direction) of the liquid storage unit 6 in the unit cover 8 (FIG. 1, FIG. 11).

The first insertion hole 28 is provided at this position, whereby the first insertion hole 28 is difficult to view in the appearance when the liquid storage unit 6 or the printer 1 is viewed from the front surface side, allowing a further simple appearance.

In the embodiment, the locking part 30 is formed by a material higher in rigidity than the unit cover 8. The unit cover 8 is formed by a resin material such as plastic, for example. It is possible to form the locking part 30 by a metal material or a resin material higher in rigidity than a resin material forming the unit cover 8.

In addition, the first insertion hole 28 provided on the unit cover 8 side is formed to be larger than the second insertion hole 33 provided on the locking part 30 side.

When a user holds up the locking member 40 or another member is unnecessarily brought into contact with the locking member 40, for example, in the state where the locking member 40 is inserted in the first insertion hole 28 and the second insertion hole 33, outer force may be added on the locking member 40. When outer force is added on the locking member 40, a load is applied also on the first insertion hole 28 and the second insertion hole 33, which may damage the holes.

The first insertion hole 28 is formed to be larger than the second insertion hole 33, whereby the locking member 40 is hardly brought into contact with the first insertion hole 28. This makes it possible to reduce a load applied on the first insertion hole 28 when force is added externally on the locked locking member 40, for example.

Furthermore, the locking part 30 is higher in rigidity than the unit cover 8. Thus, even when the locking member 40 is brought into contact with the second insertion hole 33 smaller than the first insertion hole 28, it is possible to reduce a possibility that a load is applied on the second insertion hole 33 to damage or break the hole.

In this manner, it is possible to achieve the liquid storage unit 6 high in robustness.

Locking Part

The locking part 30 will be described.

The locking part 30 (FIG. 10) of the embodiment includes the tongue-piece part 31 with the second insertion hole 33 and a fixing part 32 extended in the X axis direction crossing the tongue-piece part 31 and fixed to the ink tank 10 side, and is formed to be an L-shape in appearance. The fixing part 32 is fixed to an upper surface 27*a* of the frame member 27 by fixing screws 38, 38 as the "fixing member" fixing the fixing part 32, as illustrated in FIG. 7. In FIG. 10, symbols 34, 34 indicate screw holes 34, 34 through which the fixing screws 38, 38 are inserted.

In FIG. 10, symbols 36, 36 indicate positioning projections projecting in the −Z axis direction. As illustrated in FIG. 9, the positioning projections 36, 36 of the locking part 30 are configured to fit in positioning recesses 48, 48 provided on the upper surface 27*a* of the frame member 27, whereby the locking part 30 is positioned.

The locking part 30 is configured including the tongue-piece part 31 and the fixing part 32 extending in the direction crossing the tongue-piece part 31, which enables the locking part 30 to be arranged with space saved. The fixing part 32 is extended in the insertion/extraction direction (X axis direction) of the locking member 40 in the second insertion hole 33. Thus, it is possible to fix the fixing part 32 by the fixing screws 38, 38 inserted in the direction (Z axis direction in the embodiment) crossing the above-described insertion/extraction direction (X axis). This reduces a possibility that fixing of the locking part 30 is loosened due to insertion/extraction action of the locking member 40, enabling the locking part 30 to be fixed securely.

The fixing part 32 and the fixing screws 38, 38 fixing the fixing part 32 are positioned on the upper side of the ink tank 10, and at least a part thereof is positioned on the lower side of the closed injection port cover 11, as illustrated in FIG. 9. In the embodiment, the fixing part 32 and the fixing screw 38, 38 are provided on the lower side of the injection port covers 11*a* to 11*c* (see also FIG. 6 and FIG. 7).

In the depth direction (Y axis direction) of the liquid storage unit 6 illustrated in FIG. 8 of the embodiment, the locking part 30 is provided between the ink injection port 26 and one end side (rotation axis 47 side) in the −Y axis direction of the injection port cover 11 that is separate from the ink injection port 26 in the longitudinal direction of the injection port cover 11.

At least a part of the fixing part 32 is provided at a same position in the height direction (Z axis direction) as at least a part of the ink injection port 26 or at least a part of the cap portion 22 of the injection port cover 11.

The locking part 30 is arranged in such a manner, which enables the locking part 30 to be arranged and fixed with space saved.

Although the locking part 30 is provided as an individual member and fixed to the housing 7 side (frame member 27) in the embodiment, the locking part 30 may be formed and provided integrally with the housing 7, the frame member 27, or the like.

Arrangement of First Insertion Hole and Second Insertion Hole in Liquid Storage Unit The following will describe the arrangement of the first insertion hole 28 and the second insertion hole 33 in the liquid storage unit 6.

In the embodiment, the second insertion hole 33 is provided to be positioned between the first insertion hole 28 of the closed unit cover 8 and the injection port cover 11 in the width direction (X axis direction) of the liquid storage unit 6 illustrated in FIG. 9. This enables the second insertion hole 33 to be arranged with space saved in the liquid storage unit 6.

The first insertion hole 28 and the second insertion hole 33 are provided at positions overlapping with at least a part of the injection port cover 11 or positions on the lower side than the injection port cover 11 in the height direction (Z axis direction) of the liquid storage unit 6 illustrated in FIG. 9.

That is, the first insertion hole 28 and the second insertion hole 33 are arranged at positions close to the ink tank 10 in the height direction (Z axis direction). Thus, it is possible to reduce a load applied on the unit cover 8 with the first insertion hole 28 or the locking part 30 with the second insertion hole 33.

Particularly when the locking part 30 is formed in L-shape with the tongue-piece part 31 and the fixing part 32, as illustrated in FIG. 7 and FIG. 10, the second insertion hole 33 is provided at a position in the tongue-piece part 31 close to a bending portion 39 (FIG. 10) that is a boundary with the fixing part 32. When the second insertion hole 33 is positioned close to the bending portion 39 in the tongue-piece part 31, if the locking member 40 is inserted in the second insertion hole 33, it is difficult that force is applied in a direction in which the tongue-piece unit 31 is opened separating from the fixing part 32, which reduces a load on the locking part 30.

Other Configurations of Liquid Storage Unit

Unit Cover

The unit cover 8 includes, near a position where the first insertion hole 28 is formed, a handhold 44 (FIG. 1, FIG. 11) for opening the unit cover 8. In the embodiment, the handhold 44 is provided on the same surface as the surface on which the first insertion hole 28 is provided (right side surface 8*b*).

When the unit cover 8 includes the handhold 44, it is possible to easily open and close the unit cover 8. In addition, the first insertion hole 28 and the handhold 44 are provided at positions close to each other, which improves designability. Moreover, the first insertion hole 28 and the handhold 44, which are components used by a user are gathered close to each other, which improves usability of the user.

The locking part 30 includes a guide part 35 guiding the locking part 30 to the inner side of the unit cover 8 when the unit cover 8 is closed. To be more specific, there is provided an inclined surface as the guide part 35 at an end in the +Z axis direction of the tongue-piece part 31 of the locking part 30 (FIG. 6 and FIG. 10).

The guide part 35 makes it easier to guide the locking part 30 to the inner side of the unit cover 8, and enables the unit cover 8 to be closed smoothly.

The guide part may be provided in at least one of the unit cover 8 and the locking part 30, and it is also possible to provide the guide part in both the unit cover 8 and the locking part 30, or only on the unit cover 8 side.

The locking part 30 is configured to be replaceable. When a failure such as a damage has occurred in the second insertion hole 33 due to force added externally on the locked locking member 40, for example, the locking part 30 may be replaced.

When the user does not need a locking mechanism in the liquid storage unit 6, it is possible to remove the locking part 30 and replace it by an exchange member such as a plate not having the tongue-piece part 31 with the second insertion hole 33, for example. Such an exchange member may be formed by a resin material such as plastic, for example.

Damper Mechanism of Unit Cover

The unit cover 8 includes bearing parts 46, 46 (FIG. 12), and the rotation axes 25, 25 (FIG. 15) provided in the frame member 27 on the housing 7 side are attached to the bearing parts 46, 46, as illustrated in FIG. 6, to be rotated relative to the housing 7. Then, the unit cover 8 has a damper mechanism 50 (FIG. 6) reducing a moving speed at least when the unit cover 8 is closed.

In the embodiment, the damper mechanism 50 is configured to reduce a moving speed of the unit cover 8 when it is closed, while it is possible to move the unit cover 8 without feeling resistance of reducing a moving speed when it is opened.

The following will describe a concrete configuration of the damper mechanism 50 reducing a moving speed of the unit cover 8 when it is closed, with reference to FIG. 6, FIG. 12, and FIG. 15 to FIG. 21.

A position of A-A in FIG. 17 is slightly shifted in the −Y axis direction relative to a position of B-B of FIG. 18. FIG. 19 (perspective section view of A-A in FIG. 17) is a perspective section view shifted in the −Y axis direction relative to FIG. 20 (perspective section view of B-B in FIG. 18).

The damper mechanism 50 (FIG. 6) includes a guided part 51 (see also FIG. 12) provided on the unit cover 8, a guide groove 52 (see also FIG. 15) provided on the housing 7 side guiding the guided part 51 when the unit cover 8 is opened and closed, and a projection 53 (FIG. 16) provided on the guide groove 52. In the embodiment, the guide groove 52 is provided on the frame member 27 (see FIG. 15, FIG. 16).

The unit cover 8 changes its state from a state closed to the housing 7 (closed state) as illustrated in a left diagram of FIG. 17 to a fully opened state as illustrated in a right diagram of FIG. 18. An opening angle of the unit cover 8 in the fully opened state in the right diagram of FIG. 18 is 110°, for example. The right diagram of FIG. 17 and the left diagram of FIG. 18 illustrate the states between the closed state (opening angle $\alpha=0°$) and the fully opened state (opening angle $\alpha=110°$) of the unit cover 8. The opening angel of the right diagram of FIG. 17 is 5°, and the opening angel of the left diagram of FIG. 18 is 45°.

The action of the damper mechanism 50 when the unit cover 8 is closed will be described.

From the state where the unit cover 8 is fully opened with an opening angle of $\alpha=110°$ (right diagram of FIG. 18) to the state where the opening angle is $\alpha=45°$ as illustrated in the left diagram of FIG. 18 and then the state where the opening angle is $\alpha=5°$ (right diagram of FIG. 17), the guided part 51 is in contact with the projection 53, as illustrated in the right diagram of FIG. 20, the left diagram of FIG. 20, and the right diagram of FIG. 19.

In this manner, with the opening angle ($5°\leq\alpha\leq110°$) with which the guided part 51 is in contact with the projection 53, the closing unit cover 8 moves slowly by friction force due to contact between the guided part 51 and the projection 53. This improves operability in closing the unit cover 8.

When the unit cover 8 is closed further and the opening angle $\alpha$ of the unit cover 8 becomes smaller than 5°, the guided part 51 is not in contact with the projection 53, as illustrated in the left diagram of FIG. 19, reducing resistance of friction force due to contact between the guided part 51 and the projection 53. Therefore, it is possible to close the unit cover 8 relative to the housing 7 more securely.

The guided part 51 of the unit cover 8 is configured to be separable from the projection 53 when the unit cover 8 is opened. In the unit cover 8, the rotation axes 25, 25 and the bearing parts 46, 46 illustrated in FIG. 6 are attached so as to have a play enabling movement in the +X axis direction.

To be more specific, in the state where outer force is not applied on the unit cover 8 in the +X axis direction, the guided part 51 of the unit cover 8 is placed at a position illustrated by a solid line in FIG. 21. Then, when outer force is applied in the +X axis direction, the guided part 51 of the unit cover 8 may be moved to a position illustrated by a dotted line in FIG. 21.

The unit cover 8 includes the handhold 44 on the right side surface 8*b*, as described above. When the unit cover 8 is opened with a hand hanging on the handhold 44, force in the +X axis direction is applied on the unit cover 8, so that the unit cover 8 is moved in the +X axis direction and the guided part 51 is moved to the position illustrated by the dotted line in FIG. 21. When the guided part 51 is placed at this position, the guided part 51 is separate from the projection 53. Thus, the guided part 51 is not brought in contact with the projection 53 even when the unit cover 8 is open with 5° or more (5≤α). Alternatively, even when it is brought in contact, friction force due to the contact is smaller. In such a configuration, it is possible to easily open the unit cover 8 with small resistance.

It is also possible to provide a damper mechanism reducing a moving speed both in opening and closing the unit cover 8 in the liquid storage unit 6.

Arrangement of Liquid Storage Unit in Printer

In the embodiment, the first insertion hole 28 and the second insertion hole 33 (not viewed in FIG. 1) in the liquid storage unit 6 (FIG. 1) are arranged close to a gravity center position as the whole printer 1.

The printer 1 has a substantially rectangular form laterally long in the apparatus width direction, and the gravity center thereof is placed at a position close to a center in each of the width direction, the depth direction, and the height direction.

In the printer 1, the liquid storage unit 6 is provided at an apparatus right side end on the apparatus front surface side of the apparatus main body 2. Thus, the first insertion hole 28 and the second insertion hole 33 are provided shifted to the back surface side (−Y axis direction) of the liquid storage unit 6 so as to be positioned close to the center in the depth direction of the printer 1.

In this manner, the first insertion hole 28 and the second insertion hole 33 are arranged close to the gravity center position of the whole printer 1 in the depth direction. Thus, it is possible to reduce a load on the liquid storage unit 6 when outer force is added on the locked locking member 40 inserted in the first insertion hole 28 and the second insertion hole 33 (lower diagram in FIG. 13).

The arrangement of the liquid storage unit 6 in the printer 1 is not limited to the position of the embodiment, and the liquid storage unit 6 may be provided at another position such as the apparatus left side or the apparatus back surface side.

The invention is not limited to the above-described embodiment, and may be modified in various forms without departing from the scope of the invention described in claims, and such modifications are also included in the scope of the invention.

What is claimed is:

1. A liquid storage unit, comprising:

at least one liquid storage part that stores liquid to be supplied to a liquid ejection part ejecting the liquid and includes an injection port to which the liquid is injectable;

a first opening/closing body that is openable so as to cover the injection port when the first opening/closing body is closed; and a locking part that locks the first opening/closing body and keeps the closed state of the first opening/closing body, wherein the first opening/closing body includes a first insertion hole through which a locking member locking the closed first opening/closing body is insertable, and the locking part is provided at a position facing the first insertion hole in an area covered by the closed first opening/closing body, and includes a second insertion hole through which the locking member is insertable.

2. The liquid storage unit according to claim 1, wherein the first insertion hole is larger than the second insertion hole.

3. The liquid storage unit according to claim 2, wherein the locking part is higher in rigidity than the first opening/closing body.

4. The liquid storage unit according to claim 1, further comprising:

a housing that internally houses the liquid storage unit and is opened and closed by the first opening/closing body, wherein the first opening/closing body is closed relative to the housing with an end of a peripheral wall of the first opening/closing body butted against an end of a peripheral wall of the housing, and at least a part including the second insertion hole of the locking part projects from the housing in a height direction.

5. The liquid storage unit according to claim 1, further comprising:

a second opening/closing body that includes a cap portion opening and closing the injection port, and is covered by the closed first opening/closing body with the injection port closed by the cap portion, wherein the second insertion hole is positioned between the first insertion hole and the second opening/closing body in a width direction of the liquid storage unit.

6. The liquid storage unit according to claim 5, wherein the first insertion hole and the second insertion hole are provided at positions overlapping with at least a part of the second opening/closing body or positions lower than the second opening/closing body in the height direction.

7. The liquid storage unit according to claim 5, wherein the locking part is provided, in a depth direction, between the injection port and one end side of the second opening/closing body that is separate from the injection port in a longitudinal direction.

8. The liquid storage unit according to claim 5, wherein the locking part includes a tongue-piece part with the second insertion hole and a fixing part that is extended in a direction crossing the tongue-piece part and fixed to a side of the liquid storage unit, and the fixing part and a fixing member fixing the fixing part are positioned on an upper side of the liquid storage unit, and at least a part of the fixing part and the fixing member is positioned on a lower side of the closed second opening/closing body.

9. The liquid storage unit according to claim 8, wherein at least a part of the fixing part is placed at a same position in the height direction as at least a part of the injection port or at least a part of the cap portion of the second opening/closing body.

10. The liquid storage unit according to claim 1, wherein the locking part includes a tongue-piece part with the second insertion hole and a fixing part that is extended in a direction crossing the tongue-piece part and fixed to a side of the liquid storage unit.

11. The liquid storage unit according to claim 1, wherein the first insertion hole is provided on a side surface portion on one side in the width direction of the liquid storage unit in the first opening/closing body.

12. The liquid storage unit according to claim 1, wherein the first opening/closing body includes a handhold for opening the first opening/closing body, close to a position of the first insertion hole.

13. The liquid storage unit according to claim 1, wherein at least one of the first opening/closing body and the locking part includes a guide part guiding the locking part to an inner side of the first opening/closing body when the first opening/closing body is closed.

14. The liquid storage unit according to claim 1, wherein the locking part is configured to be replaceable.

15. The liquid storage unit according to claim 1, wherein the first opening/closing body has a damper mechanism reducing a moving speed of the first opening/closing body at least when the first opening/closing body is closed.

16. The liquid storage unit according to claim 15, wherein the damper mechanism includes a guided part that is provided in the first opening/closing body, a guide groove that is provided on the liquid storage part opened and closed by the first opening/closing body and guides the guided part when the first opening/closing body is opened and closed, and a projection provided on the guide groove, and the first opening/closing body is configured so that the guided part is brought into contact with the projection when the first opening/closing body is closed and the guided part is separable from the projection when the first opening/closing body is opened.

17. A liquid ejection apparatus, comprising:

an apparatus main body with the liquid ejection part; and the liquid storage unit according to claim 1.

18. The liquid ejection apparatus according to claim 17, wherein the first insertion hole and the second insertion hole in the liquid storage unit are arranged close to a gravity center position as a whole of the liquid ejection apparatus.

* * * * *